US009414981B2

(12) United States Patent
Tsukada et al.

(10) Patent No.: US 9,414,981 B2
(45) Date of Patent: Aug. 16, 2016

(54) BED AND SEPARATING METHOD OF THE SAME

(75) Inventors: Shohei Tsukada, Osaka (JP); Tohru Nakamura, Osaka (JP); Hideo Kawakami, Osaka (JP); Yohei Kume, Osaka (JP); Tomohiro Shimoda, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 710 days.

(21) Appl. No.: 13/701,864

(22) PCT Filed: Mar. 1, 2012

(86) PCT No.: PCT/JP2012/001402

§ 371 (c)(1),
(2), (4) Date: Dec. 4, 2012

(87) PCT Pub. No.: WO2012/124271

PCT Pub. Date: Sep. 20, 2012

(65) Prior Publication Data

US 2013/0074256 A1 Mar. 28, 2013

(30) Foreign Application Priority Data

Mar. 16, 2011 (JP) ..... 2011-057507

(51) Int. Cl.
*A61G 7/16* (2006.01)
*A61G 7/05* (2006.01)

(52) U.S. Cl.
CPC ..... *A61G 7/16* (2013.01); *A61G 7/0507* (2013.01); *A61G 2007/0513* (2013.01); *A61G 2007/0518* (2013.01); *A61G 2007/165* (2013.01); *Y10T 29/49716* (2015.01)

(58) Field of Classification Search
CPC ..... A61G 7/015; A61G 7/002; A61G 7/05; A61G 7/0507; A61G 2007/0508; A61G 2007/0513; A61G 2007/0514; A61G 2007/0518; A61G 7/10; A61G 7/1046; A61G 7/16; A61G 2007/165; A61G 13/02; A61G 13/08; A47C 1/03; A47C 7/54; B60N 2/46; B60N 2/4626; B60N 2/4646; B60N 2/4653
USPC ..... 5/86.1, 81.1 R, 425, 424, 600, 613, 617, 5/618; 280/648; 297/411.2, 297/411.35–411.38; D6/383
See application file for complete search history.

(56) References Cited

U.S. PATENT DOCUMENTS 2,609,862 A * 9/1952 Pratt ..... A61G 5/006 108/3
3,138,805 A * 6/1964 Piazza ..... A61G 5/00 297/411.34

(Continued)

FOREIGN PATENT DOCUMENTS

CN 2094988 2/1992
CN 2638699 9/2004

(Continued)

OTHER PUBLICATIONS

Chinese Office Action (OA) issued Sep. 22, 2013 in Chinese Patent Application No. 201280001735.5, together with English translation thereof.

(Continued)

*Primary Examiner* — Robert G Santos
(74) *Attorney, Agent, or Firm* — Wenderoth, Lind & Ponack, L.L.P.

(57) ABSTRACT

A bed includes a first rail, a second rail, a wheelchair having a first armrest mounting unit to and from which the first rail is attached and detached in one side part, and a second armrest mounting unit to and from which the second rail is attached and detached in another side part. A bed main body portion has a first support portion and a second support portion, and the first support portion has a first bed mounting unit to and from which the first rail or the second rail is attached and detached in a front end. The second support portion has a second bed mounting unit to and from which the first rail or the second rail is attached and detached in a front end.

14 Claims, 29 Drawing Sheets

(56) References Cited

U.S. PATENT DOCUMENTS

| | | | | | |
|---|---|---|---|---|---|
| 4,240,169 | A * | 12/1980 | Roos | A61G 3/06 | 297/DIG. 4 |
| 5,438,722 | A * | 8/1995 | Jayamanne | A61G 5/006 | 5/425 |
| D644,850 | S * | 9/2011 | Sakakibara | D6/383 | |
| D645,273 | S * | 9/2011 | Sakakibara | D6/383 | |
| D645,674 | S * | 9/2011 | Sakakibara | D6/383 | |
| 8,474,075 | B2 * | 7/2013 | Kawakami | A61G 5/006 | 5/600 |
| 8,677,523 | B2 * | 3/2014 | Tsukada | A61G 5/006 | 5/2.1 |
| 8,677,524 | B2 * | 3/2014 | Kume | A61G 5/04 | 5/613 |
| 8,718,859 | B2 * | 5/2014 | Kume | A61G 5/006 | 180/168 |
| 8,950,776 | B2 * | 2/2015 | Tsukada | A61G 5/006 | 280/30 |
| 9,004,508 | B2 * | 4/2015 | Tsukada | A61G 7/00 | 280/47.4 |
| 9,050,223 | B2 * | 6/2015 | Ohta | A61G 7/018 | |
| 2011/0030138 | A1 * | 2/2011 | Kawakami | A61G 5/006 | 5/2.1 |
| 2011/0196562 | A1 * | 8/2011 | Kume | A61G 5/006 | 701/23 |
| 2012/0153687 | A1 * | 6/2012 | Kume | A61G 5/1067 | 297/118 |
| 2012/0159705 | A1 * | 6/2012 | Tsukada | A61G 5/006 | 5/2.1 |
| 2012/0169093 | A1 * | 7/2012 | Kume | A61G 5/04 | 297/118 |
| 2012/0181779 | A1 * | 7/2012 | Tsukada | A61G 5/006 | 280/648 |
| 2013/0074256 | A1 * | 3/2013 | Tsukada | A61G 7/16 | 5/81.1 R |
| 2014/0137328 | A1 * | 5/2014 | Ohta | A61G 7/018 | 5/611 |
| 2014/0191541 | A1 * | 7/2014 | Ohta | A61G 5/04 | 297/118 |
| 2014/0319804 | A1 * | 10/2014 | Tsukada | A61G 7/00 | 280/648 |
| 2015/0082537 | A1 * | 3/2015 | Ohta | A61G 5/04 | 5/2.1 |

FOREIGN PATENT DOCUMENTS

| | | |
|---|---|---|
| CN | 2657635 | 11/2004 |
| CN | 201542844 | 8/2010 |
| CN | 101889926 | 11/2010 |
| DE | 41 30 610 | 3/1993 |
| JP | 5-51330 | 7/1993 |
| JP | 2002-238953 | 8/2002 |

OTHER PUBLICATIONS

Chinese Search Report (SR) issued Sep. 22, 2013 in Chinese Patent Application No. 201280001735.5, together with English translation thereof.

International Preliminary Report on Patentability issued Oct. 10, 2013 in International (PCT) Application No. PCT/JP2012/001402.

Supplementary European Search Report (ESR) issued Jul. 31, 2014 in corresponding European Patent Application No. EP 12 75 7936.

International Search Report issued Apr. 24, 2012 in International (PCT) Application No. PCT/JP2012/001402.

* cited by examiner

BED AND SEPARATING METHOD OF THE SAME

TECHNICAL FIELD

The present invention relates to a bed in which a part thereof can be separated as a wheelchair, and a separating method of the same.

BACKGROUND ART

In nursing care, there is a case where a care-receiver is moved from a bed into a wheelchair or a case where the care-receiver is moved from the wheelchair onto the bed. The care-receiver indicates for example, a bedridden aged person or an ailing person. Such movement is difficult and there is a possibility that a care worker suffers from lumbar pain at the time of the movement. Thus, a bed device in which a part of the bed is dividable and the part can be changed to a wheel chair is proposed (for example, refer to Japanese Unexamined Utility Model Publication No. 5-51330).

FIG. 16 is a perspective view of a conventional bed device 10. As shown in FIG. 16, abed surface of the bed device 10 is composed of three plates of a side bed plate 2, a center bed plate 3, and a side bed plate 4. In order to form the bed surface, there is a need for moving the center bed plate 3 of a wheelchair 5 in a flat posture to a space 3*a* between the side bed plate 2 and the side bed plate 4 as shown in FIG. 16. Therefore, with a rotation mechanism 7, by firstly rotating an arm 8 in the arrow 7*a* direction about a rotation center of the rotation mechanism, the care worker brings the side bed plate 4 fixed to the arm 8 up to the upper side of a bed main body 1.

The care worker moves the wheelchair 5 on which the care-receiver rides to the space 3*a* in a state that the side bed plate 4 is brought up to the upper side of the bed main body 1. After the wheelchair 5 is moved to the space 3*a*, when the side bed plate 4 is returned to the original position, the bed surface is composed of the side bed plates 2, 4 and the center bed plate 3. In such a way, the care-receiver can be easily moved from the wheelchair 5 to the bed device 10. By performing the procedure reverse to the above description, the care-receiver can be easily moved from the bed device 10 to the wheelchair 5.

It should be noted that at the time of coupling the wheelchair 5 to the bed main body portion 1, a pair of rails 9 of the wheelchair 5 utilized as armrests are shifted into insertion holes 9*a*, 9*b* of the bed main body portion 1 from the wheelchair 5 and utilized as side rails for the bed device 10.

In such a way, by using the bed device 10 having the wheelchair 5 as a part thereof, labor of the care worker to move the care-receiver between the wheelchair 5 and the bed main body 1 can be reduced.

TECHNICAL PROBLEM

However, in the conventional bed device 10, length of the rails 9 on the both sides is short in comparison to length in the longitudinal direction of the bed device 10. Therefore, when the care-receiver moves his/her body, the care-receiver cannot be supported by the rails 9, and the care-receiver is sometimes slipped off.

Thus, an object of the present invention is to provide a highly safe bed having a low possibility that a care-receiver is slipped off, and a separating method of the bed.

SUMMARY OF THE INVENTION

In order to achieve the above object, the present invention is formed as below.

In order to solve the problem, a bed of the present invention

A bed of the present invention, comprises:

a first rail;

a second rail;

a wheelchair having a first armrest mounting unit to and from which the first rail is attachable and detachable in one side part thereof, and a second armrest mounting unit to and from which the second rail is attachable and detachable in an other side part thereof; and a bed main body portion having a first support portion and a second support portion in one side part and a bed rail in an other side part thereof, wherein the first support portion has a first bed mounting unit to and from which the first rail or the second rail is attachable and detachable, and the second support portion has a second bed mounting unit to and from which the first rail or the second rail is attachable and detachable.

A bed of the present invention, comprises:

a first rail;

a second rail;

a wheelchair having a first armrest mounting unit to and from which the first rail is attachable and detachable in one side part thereof, a second armrest mounting unit to and from which the second rail is attachable and detachable in an other side part, and a first bed mounting unit and a second bed mounting unit arranged so as to sandwich the first armrest mounting unit in the one side part thereof; and a bed main body portion having a bed rail in a side part thereof, wherein the first rail or the second rail is attachable to and detachable from the first bed mounting unit and the second bed mounting unit.

A separating method of a bed of the present invention is a separating method of the bed having a first armrest formation step for removing the second rail from the second bed mounting unit and installing the second rail in the second armrest mounting unit, and a second armrest formation step for removing the first rail from the first bed mounting unit and installing the first rail in the first armrest mounting unit.

Advantageous Effects of Invention

In the present invention, a highly safe bed having a low possibility that a care-receiver is slipped off, and a separating method of this bed can be provided.

BRIEF DESCRIPTION OF DRAWINGS

The features of the present invention will become clear from the following description taken in conjunction with the embodiments thereof with reference to the accompanying drawings, in which.

DESCRIPTION OF EMBODIMENTS

Figure 1A:
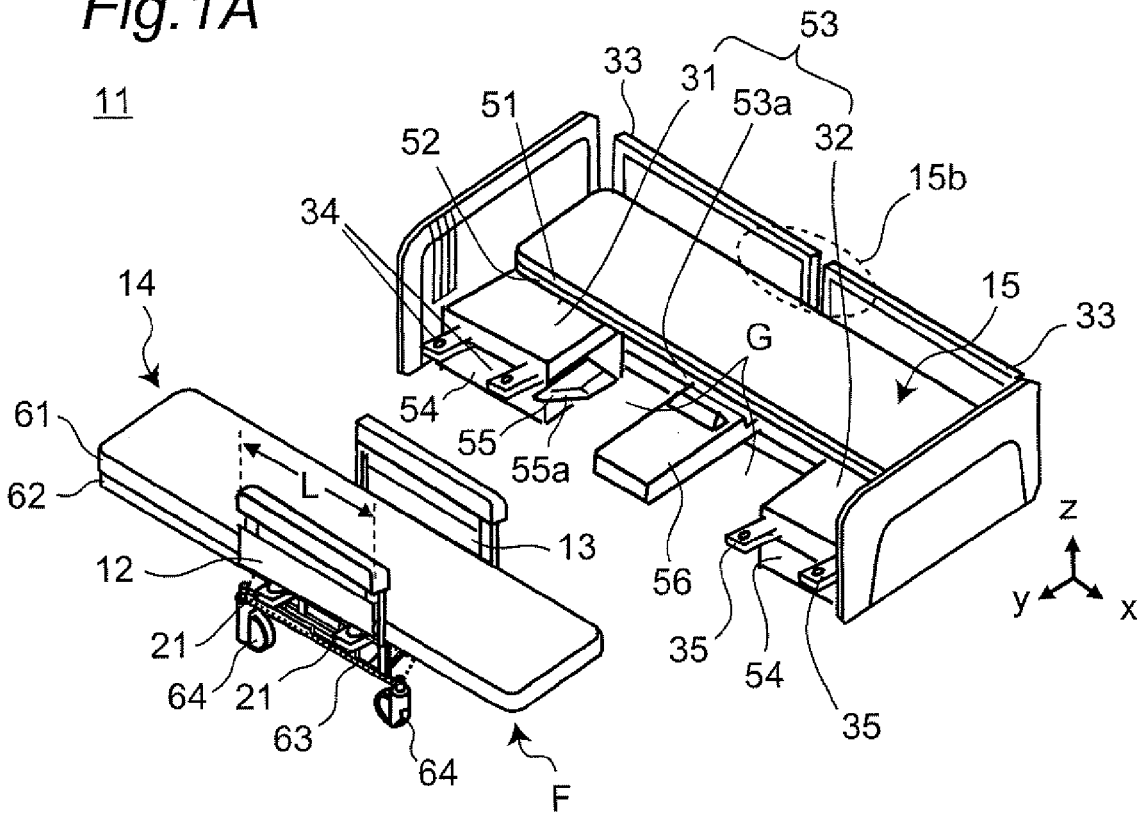
FIG. 1A is a perspective view of a bed in a separated state for illustrating the bed according to a first embodiment of the present invention.

Hereinafter, embodiments of the present invention will be described with reference to the drawings. It should be noted that the same constituent elements will be given the same reference numerals, and description thereof will sometimes be omitted. For easy understanding, the drawings are schematically focusing on the constituent elements. In order to clarify corresponding relationships between the figures, X, Y, and Z axes are appropriately shown in the figures.

In the following description, a person who uses a bed is called a care-receiver (for example, a bedridden aged person or an ailing person), and a person who aids the care-receiver to use the bed is called a care worker.

First Embodiment

A bed according to a first embodiment of the present invention is a bed in which a wheelchair can be separated, and armrests (a pair of rails) drawn from the wheelchair are installed in line on one side of the bed and used as side rails. That is, the pair of rails of the bed according to the first embodiment is used as the armrests in a chair posture C (posture of a wheelchair 14 shown in FIG. 1C), and used as the side rails on one side in a bed state B (state that the wheelchair 14 and a bed main body portion 15 are combined shown in FIG. 1B). It should be noted that although a detail will be described later, side rails on the other side of the bed are always placed in line on the bed. The wheelchair can be separated from the bed for easily performing a moving task from the bed to the wheelchair.

Figure 1B:
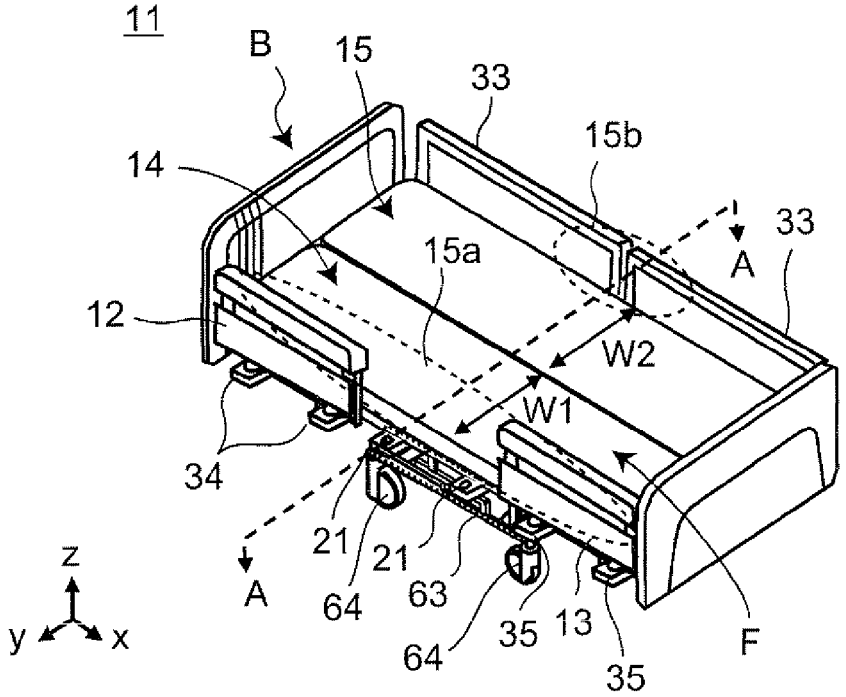
FIG. 1B is a perspective view of the bed in a coupled state for illustrating the bed according to the first embodiment of the present invention.

FIGS. 1A and 1B are views for illustrating a bed 11 according to the first embodiment of the present invention. FIG. 1A is a perspective view of the bed 11 in a separated state. FIG. 1B is a perspective view of the bed 11 in a coupled state.

Figure 2:
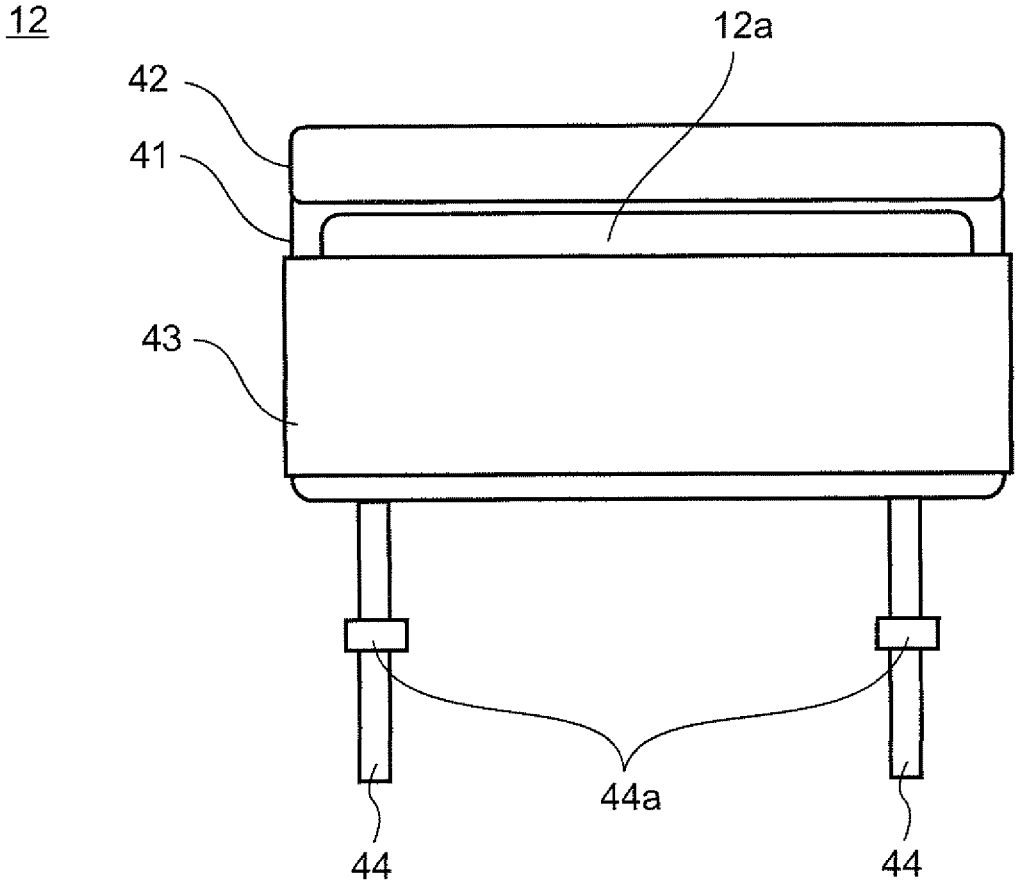
FIG. 2 is a side view of a first rail of the bed according to the first embodiment.

As shown in FIGS. 1A, 1B, the bed 11 is provided with a first rail 12, a second rail 13, the wheelchair 14, and the bed main body portion 15. Although the description will be given later with FIG. 2, as shown in FIG. 2, the first rail 12 and the second rail 13 respectively have a structure in which two support rod portions 44 protrude from lower parts of a rectangular plate shape support body 41.

The wheelchair 14 has a pair of first armrest mounting units 21 in a center part of one side part (for example, a side part on the near side in FIG. 1A). The first rail 12 is attachable to the pair of first armrest mounting units 21 as an armrest, and the first rail 12 can be detachably attached and detached. As one example, the pair of first armrest mounting units 21 is formed as insertion holes to and from which lower ends of the two support rods of the first rail 12 are attachable and detachable.

This wheelchair 14 has a pair of second armrest mounting units 22 (refer to FIGS. 6A to 6C and FIG. 7, etc.) in a center part of the other side part (for example, a side part on the far side in FIG. 1A). The second rail 13 can be attached to and detached from the pair of second armrest mounting units 22 attachably and detachably as an armrest. As one example, the pair of second armrest mounting units 22 is formed as insertion holes to and from which lower ends of the two support rods of the second rail 13 are attachable and detachable.

Figure 1C:
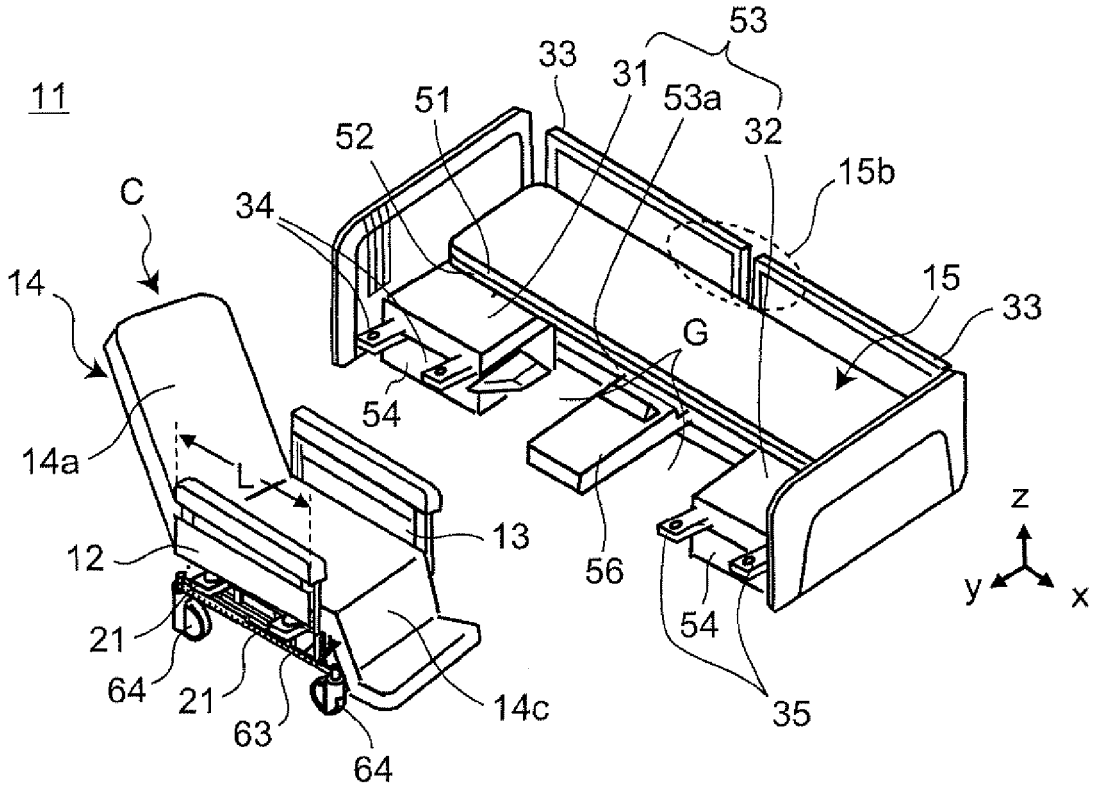
FIG. 1C is a perspective view of the bed in a wheelchair state for illustrating the bed according to the first embodiment of the present invention.

When the wheelchair 14 is used as a part of the bed 11, the wheelchair 14 is in a flat posture F in which an upper surface is flatly placed as shown in FIGS. 1A and 1B. However, when the wheelchair 14 is used as a single body, as shown in FIG. 1C, a backrest 14*a* is brought upward and a point 14*c* for supporting legs is lowered, so that the wheelchair 14 is transformed into the chair posture C and utilized as a wheelchair.

When the wheelchair 14 is used as a single body, the first rail 12 is attached to the first armrest mounting units 21, and the second rail 13 is attached to the second armrest mounting units 22. The first rail 12 and the second rail 13 attached to the second armrest mounting units 22 are respectively utilized as the armrests (arm rests) of the wheelchair 14.

The bed main body portion 15 has one first support portion 31 and one second support portion 32 protruding sideward in one side part (for example, a side part on the near side in FIG. 1A). The first support portion 31 and the second support portion 32 of this bed main body portion 15 are to support the wheelchair 14 in the coupled state.

The bed main body portion 15 also has two bed rails 33 in the other side part (for example, a side part on the far side in FIG. 1A). When the wheelchair 14 is separated from the bed main body portion 15 and when the wheelchair 14 is coupled to the bed main body portion 15, the two bed rails 33 are not detached but held to be fixed.

The first support portion 31 has a pair of first bed mounting units 34 in a front end (an outer end in the width direction of the bed main body portion 15). The pair of first bed mounting units 34 is to attachably and detachably attach and detach the first rail 12 as a bed rail. As one example, the pair of first bed mounting units 34 is formed as insertion holes to and from which the lower ends of the two support rods of the first rail 12 are attachable and detachable.

The second support portion 32 has a pair of second bed mounting units 35 in a front end (an outer end in the width direction of the bed main body portion 15). The pair of second bed mounting units 35 is to attachably and detachably attach and detach the second rail 13 as a bed rail. As one example, the pair of second bed mounting units 35 is formed as insertion holes to and from which the lower ends of the two support rods of the second rail 13 are attachable and detachable.

A space between the first support portion 31 and the second support portion 32 of the bed main body portion 15 is an accommodation space G.

When the separated state is brought into the coupled state, the second armrest mounting units 22 of the wheelchair 14 are set to face this accommodation space G, and the wheelchair 14 is brought close in the width direction of the bed main body portion 15 in such a manner that the second armrest mounting units 22 are inserted into the accommodation space G, so that the wheelchair 14 and the bed main body portion 15 are coupled. When coupling is performed in such a way, the first armrest mounting units 21 are arranged in the accommodation space G as well as the second armrest mounting units 22. Thus, the first bed mounting units 34 and the second bed mounting units 35 protrude toward the side of the first armrest mounting units 21. At this time, the first armrest mounting units 21 are arranged between the first bed mounting units 34 and the second bed mounting units 35.

With such a configuration, in a state that the wheelchair 14 and the bed main body portion 15 are coupled (that is, the bed state B shown in FIG. 1B), the lower ends of the two support rods of the first rail 12 are installed into the insertion holes of the pair of first bed mounting units 34, and the lower ends of the two support rods of the second rail 13 are installed into the insertion holes of the pair of second bed mounting units 35. As a result, in the bed state B, the first rail 12 and the second rail 13 are placed in line on one side of the bed 11. With this configuration, on a side surface of the bed 11 in which the first rail 12 and the second rail 13 are installed, a space formed between the two rails 12, 13 where no rail exists (gap in center on the one side of the bed 11) can be narrowed. Therefore, even when the care-receiver lying on the bed 11 moves his/her body toward the first rail 12 and the second rail 13, the side of upper body or lower body of the care-receiver is supported by at least one of the first rail 12 and the second rail 13, so that a possibility of slipping off the bed 11 is lowered. That is, with the configuration of the first embodiment, the highly safe bed 11 from which the wheelchair 14 is separable can be provided.

It should be noted that in the present embodiment, each rail length L of the first rail 12 and the second rail 13 is length which is one third or more and less than one half of the total length in the longitudinal direction of the bed 11. When the each rail length L of the first rail 12 and the second rail 13 is one third or more of the total length in the longitudinal direction, the rails can be used as the bed rails for preventing fall of a person in the bed state B. When the each rail length L of the first rail 12 and the second rail 13 is less than one half of the total length in the longitudinal direction, the rails can be mounted as the bed rails in terms of structure. For example, in the present embodiment, the total length in the longitudinal direction of the bed 11 is 190 cm. Thus, the each rail length L of the first rail 12 and the second rail 13 is 70 cm.

In the first embodiment, by arranging the first bed mounting units 34 and the second bed mounting units 35 in line on the one side of the bed 11, the bed 11 is formed in such a manner that the first rail 12 and the second rail 13 are easily shifted. For example, when the care worker shifts the first rail 12 and the second rail 13 from the state of FIG. 1A into the state of FIG. 1B, the care worker is not required to move to both the sides of the bed 11, so that the care worker can shift the first rail 12 and the second rail 13 from the one side of the bed 11. Specifically, a mat width W1 of the wheelchair 14 (refer to FIG. 1B) is for example about 50 cm. Thus, by extending his/her arm, the care worker can draw the first rail 12 and the second rail 13 and install the rails into the first bed mounting units 34 and the second bed mounting units 35 without moving from the side of the first armrest mounting units 21 of the wheelchair 14.

Meanwhile, in a case where the first bed mounting units 34 and the second bed mounting units 35 of the first embodiment are not used, it is difficult to install the second rail 13 on the other side 15*b* of the bed main body portion 15. Specifically, a mat width W2 of the bed main body portion 15 (refer to FIG. 1B) is for example about 50 cm, and a width of the bed 11 becomes for example about 100 cm. Thus, in a case where the first bed mounting units 34 and the second bed mounting units 35 of the first embodiment are not used, the care worker is required to shift the rails to positions 100 cm far from the one side by making his/her body overhung the body of the care-receiver. Therefore, in a case where the first bed mounting units 34 and the second bed mounting units 35 of the first embodiment are not used, the care worker is required to go to the other side 15*b* of the bed main body portion 15 and perform installation. When such an action is required, labor and a working time of the care worker are increased.

By placing the first bed mounting units 34 and the second bed mounting units 35 in line on the one side 15*a* of the bed 11 in such a way, the care worker is not required to go around the bed 11 and go back and forth to both the sides of the bed 11. Therefore, by placing the first bed mounting units 34 and the second bed mounting units 35 in line on the one side 15*a* of the bed 11, the labor of the care worker can be reduced and the working time can be shortened.

Figure 3A:
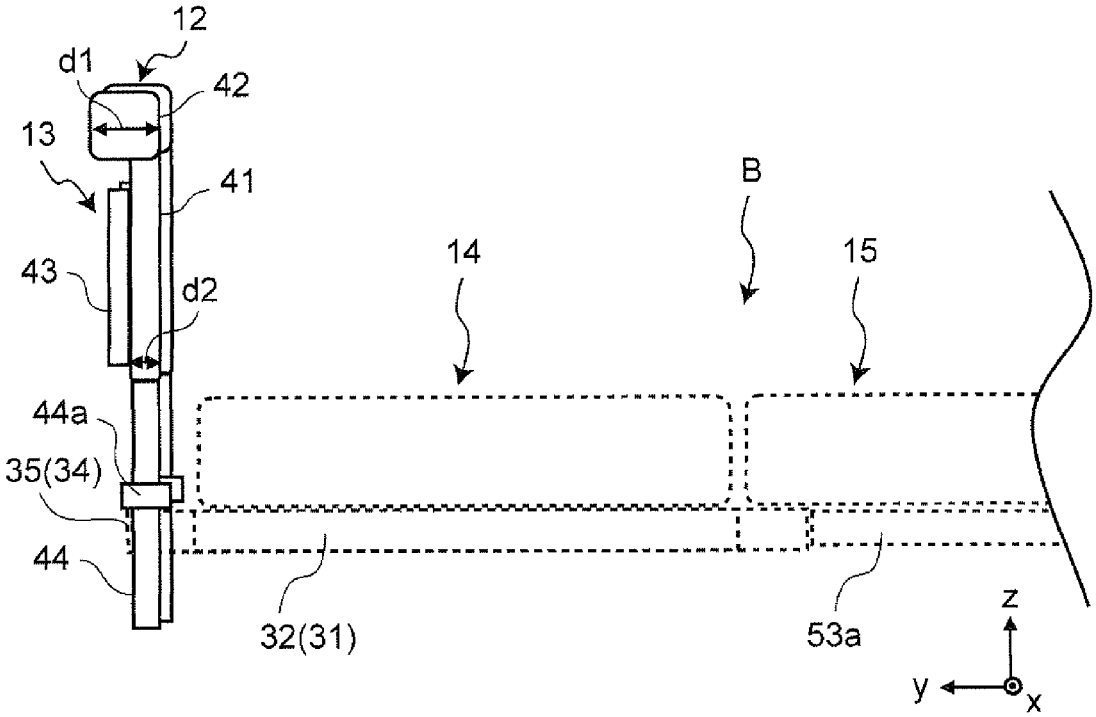
FIG. 3A is a front view of the first rail in a bed state of the bed according to the first embodiment.
Figure 3B:
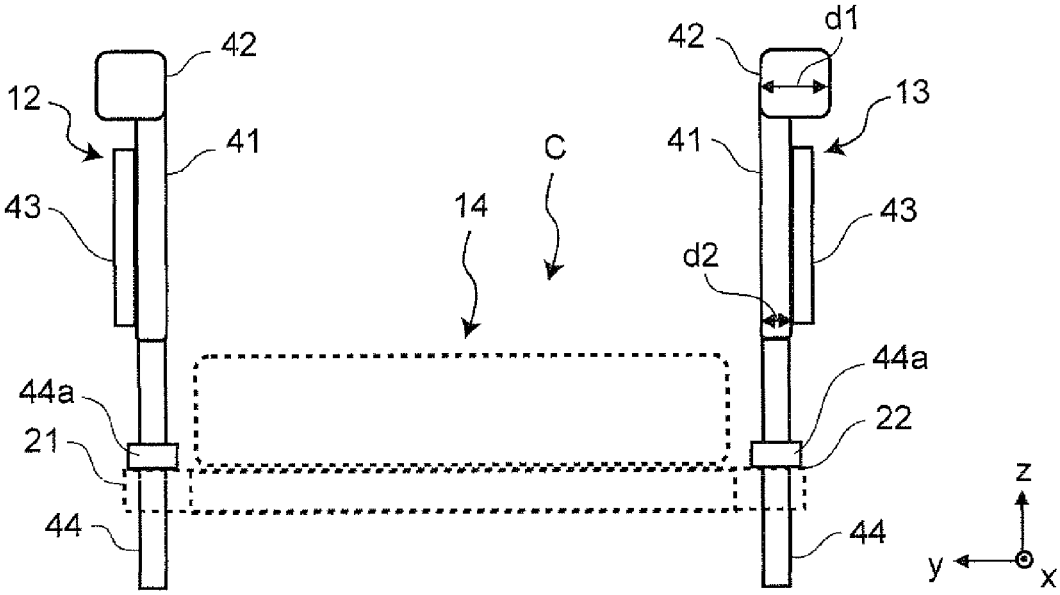
FIG. 3B is a front view of the first rail and a second rail in the wheelchair state of the bed according to the first embodiment.

FIG. 2 is a side view of the first rail 12 according to the first embodiment. FIGS. 3A and 3B are front views of the first rail 12 according to the first embodiment (views in which the first rail 12 is seen from the side when installed in the wheelchair 14).

As shown in FIGS. 2, 3A, and 3B, the first rail 12 has the support body 41, an armrest portion 42, and a plate portion 43. The support body 41 is a member having the two support rod portions 44 at a lower end. The support body 41 can be composed of processing an iron pipe for example. The armrest portion 42 is a rectangular parallelepiped member provided in an upper part of the support body 41, the member protruding sideward only on one surface of the support body 41. The plate portion 43 is a rectangular plate shape member provided in the support body 41, the member covering a surface of the support body 41. Instead of a plate shape member, a cloth-like member can be used as the plate portion 43. The plate portion 43 is not always required but may desirably be provided according to need. A width d1 of the armrest portion 42 is larger than a width d2 of the support body 41. The width d1 of the armrest portion 42 is larger than the width d2 of the support body 41 in order to extend an area where an elbow of the care-receiver is disposed. As one example, the width d1 is about 18 to 25 mm, and the width d2 is about 45 to 70 mm. The support body 41 is composed of bending a metal pipe into a bracket (]) shape.

A space (gap) 12*a* exists between the metal pipe and the metal pipe of the support body 41. However, this space 12*a* is closed from the outer side by the plate portion 43 while leaving a gap in an upper part. In a case where the space is not closed by the plate portion 43, the space 12*a* is so large that an arm can be inserted in between the metal pipe and the metal pipe of the support body 41. In a state that the arm of the care-receiver is inserted in the space 12*a*, and when the care worker performs back lifting without knowing the state, there is a risk that the arm of the care-receiver is caught and bones are broken. However, by closing the space 12*a* by the plate portion 43 while leaving the gap in the upper part, such a situation can be prevented. In the first embodiment, the gap in the upper part of the space 12*a* is a gap of an extent that the arm cannot be inserted (for example, about 25 to 35 mm). With the gap to this extent, at the time of attaching and detaching the first rail 12, the care worker or the like can grip the armrest portion 42, so that the moving task is easily performed. By forming the plate portion 43 by a transparent plastic plate, visibility of the care-receiver is not narrowed even when the care-receiver lies on the bed 11, so that the bed 11 becomes comfortable for the care-receiver. For a purpose of easing impact when the care-receiver makes contact, the plate portion 43 may be formed of cloth or the plate portion 43 may be formed of mesh of metal or plastic.

The support rod portions 44 of the first rail 12 are inserted into the insertion holes of the first armrest mounting units 21 or the first bed mounting units 34. Stoppers 44*a* are fixed to intermediate parts of the support rod portions 44. The support rod portions 44 on the lower sides of the stoppers 44*a* are inserted into the insertion holes of the first armrest mounting units 21 or the first bed mounting unit 34 and the stoppers 44*a* are brought into contact with peripheries of the insertion holes, so that lower end positions of the support rod portions 44 are determined.

It should be noted that although the first rail 12 is described with using FIGS. 2, 3A, and 3B, the second rail 13 also has the support body 41, the armrest portion 42, and the plate portion 43 as well as the first rail 12. However, the protruding direction of the armrest portion 42 of the second rail 13 is opposite to the first rail 12, and the direction is outward when the second rail 13 is installed in the wheelchair 14 (refer to FIG. 3B). That is, the protruding direction of the armrest portions 42 in the first embodiment is outward (the direction moving away from the bed) in both the bed state B and the wheelchair state (chair posture) C. Since the protruding direction of the armrest portions 42 is outward, at the time of inserting the first rail 12 and the second rail 13 into the first armrest mounting units 21 and the second armrest mounting units 22, a mat portion 61 and the armrest portions 42 are not brought into contact with each other. Therefore, even with the configuration that the first rail 12 and the second rail 13 are provided with the armrest portions 42 as in the first embodiment, a posture of the wheelchair 14 can be changed.

Next, a mechanism for coupling the wheelchair 14 and the bed main body portion 15 will be described.

As shown in FIGS. 1A and 1B, the bed main body portion 15 has a mat portion 51, a bed portion 52, a bed base portion 53, a pair of elevating portions 54, a guide portion 55, and a coupling mechanism portion 56. The bed portion 52 supports the mat portion 51. The bed base portion 53 supports the bed portion 52. The pair of elevating portions 54 supports the bed base portion 53 and is arranged on the head side and the leg side. The guide portion 55 is coupled to the bed base portion 53 and guides the wheelchair 14 to a coupling position. The coupling mechanism portion 56 is coupled to the bed base portion 53. The bed base portion 53 has the first support portion 31, the second support portion 32, and a center support portion 53*a*.

The elevating portions 54 function as one example of an elevating machine for the bed main body portion 15 and are provided with for example, a link mechanism extendable and contractible in the vertical direction so as to move the entire bed base portion 53 parallel in the vertical direction, and an elevating motor coupled to a link of the link mechanism so as to extend and contract the link mechanism by forward/backward rotation of a rotation shaft. When a position of the bed base portion 53 is raised, a chair base portion 63 of the wheelchair 14 and the coupling mechanism portion 56 are brought into contact with each other, and the chair base portion 63 is supported by the coupling mechanism portion 56. Meanwhile, when the position of the bed base portion 53 is lowered, the coupling mechanism portion 56 is separated from the chair base portion 63, and support of the chair base portion 63 by the coupling mechanism portion 56 is cancelled.

The coupling mechanism portion 56 is arranged in a center part of the accommodation space G between the first support portion 31 and the second support portion 32 of the bed main body portion 15.

The guide portion 55 includes a plate shape member having an inclined surface 55*a*. When the wheelchair 14 and the bed main body portion 15 are coupled, the guide portion 55 guides the chair base portion 63 brought into contact with the inclined surface 55*a* into the accommodation space G.

It should be noted that the bed main body portion 15 is provided with known back lifting and knee lifting linear actuators (not shown), so that a back lifting action and a knee lifting action by the mat portion 51 are independently performed. That is, the bed 11 functions as an electric nursing care bed in the coupled state.

The wheelchair 14 has the mat portion 61, a chair portion 62, the chair base portion 63, and four casters 64. The chair portion 62 supports the mat portion 61 and is changeable to the seating posture (chair posture) C and the flat posture F. The chair base portion 63 supports the chair portion 62. The four casters 64 freely move the chair base portion 63. It should be noted that parts of the chair base portion 63 are the first armrest mounting units 21 and the second armrest mounting units 22.

In a case where the wheelchair 14 and the bed main body portion 15 are coupled, firstly, as shown in FIG. 1B, the wheelchair 14 is moved to the accommodation space G serving as the coupling position of the bed main body portion 15. When the elevating portions 54 of the bed main body portion 15 are raised in such a state, the wheelchair 14 is coupled to the bed main body portion 15. At this time, the four casters 64 are floated up from a bed surface on which the bed main body portion 15 is mounted. It should be noted that the bed main body portion 15 may be supported by four casters (not shown) having brake movably on the bed surface or may be fixed and arranged on the bed surface by four simple support rods.

Next, a separating method of the wheelchair 14, that is, a method for separating the wheelchair 14 from the bed main body portion 15 will be described.

Figure 4A:
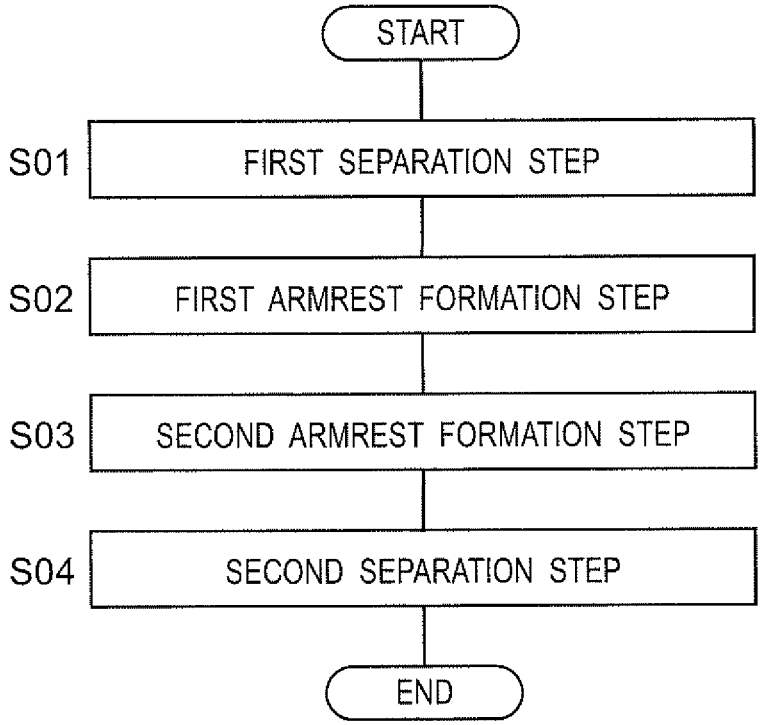
FIG. 4A is a flowchart of a separating method of a wheelchair from a bed main body portion according to the first embodiment.
Figure 5A:
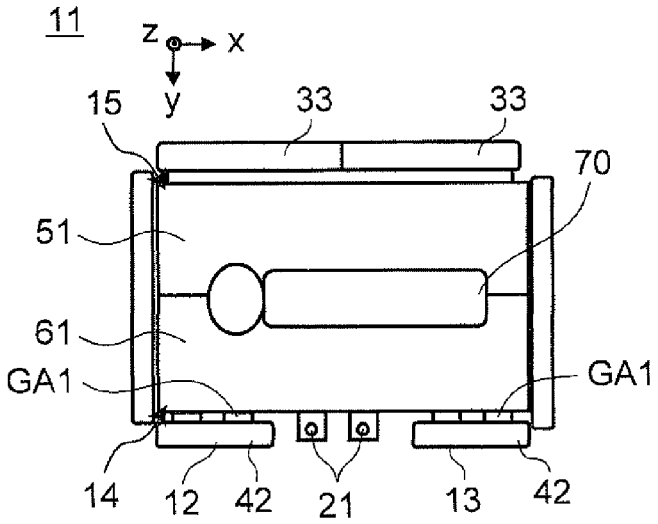
FIG. 5A is a plan view of the bed at the time of coupling for illustrating separation of the wheelchair from the bed main body portion according to the first embodiment.
Figure 5B:
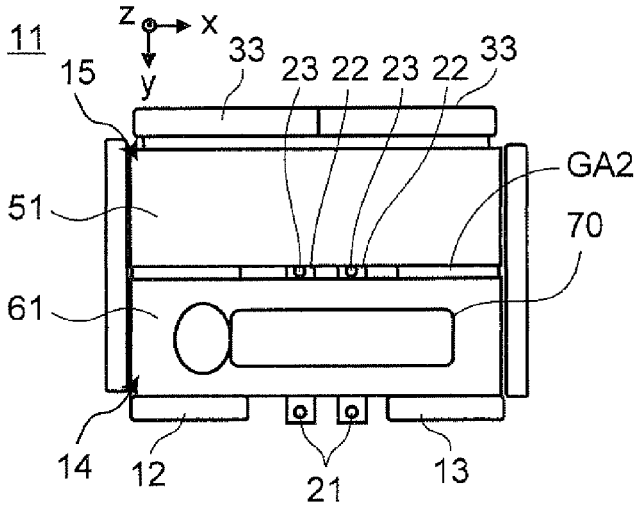
FIG. 5B is a first plan view of the bed in a locked state for illustrating the separation of the wheelchair from the bed main body portion according to the first embodiment.
Figure 5C:
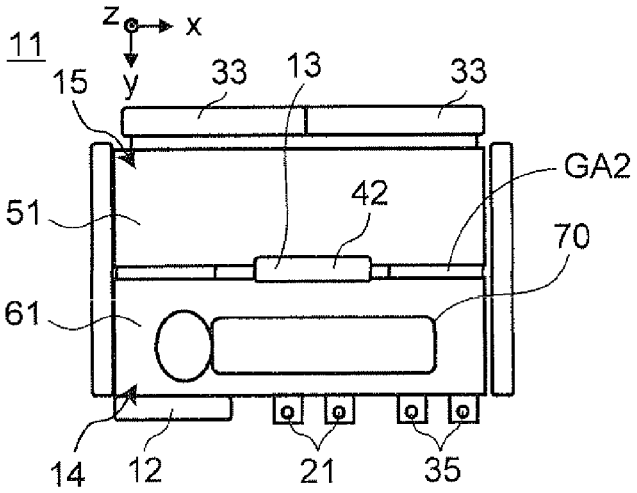
FIG. 5C is a second plan view of the bed in the locked state for illustrating the separation of the wheelchair from the bed main body portion according to the first embodiment.
Figure 5D:
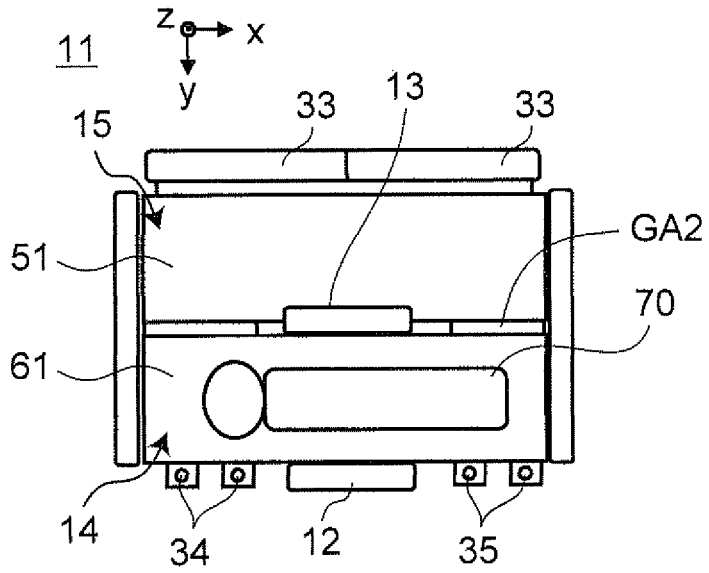
FIG. 5D is a third plan view of the bed in the locked state for illustrating the separation of the wheelchair from the bed main body portion according to the first embodiment.
Figure 5E:
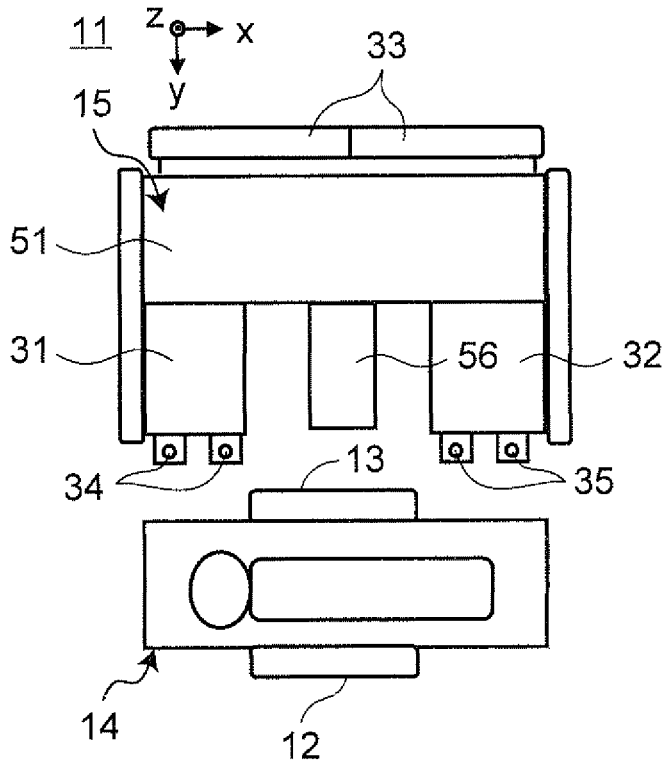
FIG. 5E is a plan view of the bed at the time of separation for illustrating the separation of the wheelchair from the bed main body portion according to the first embodiment.

FIG. 4A is a flowchart of the separating method of the wheelchair 14 from the bed 11 according to the first embodiment. FIGS. 5A to 5E are views for illustrating separation of the wheelchair 14 from the bed 11 according to the first embodiment. FIG. 5A is a plan view of the bed at the time of coupling. FIG. 5B is a first plan view of the bed in a locked state. FIG. 5C is a second plan view of the bed in the locked state. FIG. 5D is a third plan view of the bed 11 in the locked state. FIG. 5E is a plan view of the bed 11 at the time of separation. With using FIGS. 4A and 5A to 5E, the separating method of the wheelchair 14 will be described.

The first rail 12 and the second rail 13 are arranged in such a manner that the armrest portions 42 protrude outward in the bed state B (refer to FIG. 3A). With this arrangement, the mat portions 51, 61 are not brought into interference with the armrest portions 42, and the posture of the bed 11 can be changed.

In a state of FIG. 5A, gaps GA1 are formed between the first rail 12 and the second rail 13, and the mat portion 61. Provided that a care-receiver 70 lies in the vicinity of center of the mat portions 51, 61. In such a bed state B, the first rail 12 and the second rail 13 are installed in the first bed mounting units 34 and the second bed mounting units 35, and the mat portion 61 of the wheelchair 14 can be brought into contact with the first rail 12 and the second rail 13. Therefore, the wheelchair 14 cannot be separated from the bed main body portion 15 and is brought into the locked state.

In the first embodiment, the method for separating the wheelchair 14 from the bed main body portion 15 will be described. Firstly, a position where the care-receiver 70 lies is changed by an action of the care worker or the care-receiver 70 himself/herself so that the care-receiver 70 lies only on the mat portion 61 on the side of the wheelchair 14.

After that, the care worker operates an operation switch or the like so as to drive the two elevating portions 54 and lower the two elevating portions 54 of the bed main body portion 15. Thus, a position of the coupling mechanism portion 56 is lowered together with the bed base portion 53, and the coupling mechanism portion 56 is separated from the chair base portion 63 of the wheelchair 14.

When the wheelchair 14 is moved in the direction in which the wheelchair 14 is separated from the bed main body portion 15 along the width direction of the bed main body portion 15 in this state, the gaps GA1 between the first rail 12 and the second rail 13, and the mat portion 61 are eliminated and the mat portion 61 of the wheelchair 14 is brought into contact with the first rail 12 and the second rail 13. Thus, the wheelchair 14 cannot be separated from the bed main body portion 15 anymore. That is, when the mat portion 61 is separated from the mat portion 51 in the bed state B, as shown in FIG. 5B, a gap GA2 is formed between the mat portion 51 and the mat portion 61. Installment parts (insertion holes 23) of the pair of second armrest mounting units 22 hidden by the mat portion 61 are exposed in the gap GA2. In such a way, a first separation step S01 for pulling out the wheelchair 14 from the bed main body portion 15 (refer to FIG. 4A) is performed. Thereby, as shown in FIG. 5B, the insertion holes 23 of the pair of second armrest mounting units 22 appear in the gap GA2 between the mat portion 51 and the mat portion 61.

It should be noted that when the gaps GA1 exist between the first rail 12 and the second rail 13, and the mat portion 61 of the wheelchair 14 in the bed state B, there is a risk that fingers of the care worker or the care-receiver 70 are caught or the like. In order to prevent this, desirably, when using as the bed 11, the gaps GA1 are not formed, and when the bed main body portion 15 is lowered for separating the wheelchair 14 from the bed main body portion 15, the gaps GA1 are formed between the first rail 12 and the second rail 13, and the wheelchair 14.

Next, as shown in FIG. 5C, the care worker removes the second rail 13 from the second bed mounting units 35, and installs this second rail 13 in the pair of second armrest mounting units 22. This task is a first armrest formation step S02 (refer to FIG. 4A). At this time, the care worker mounts the second rail 13 in the second armrest mounting units 22 in such a manner that the armrest portion 42 of the second rail 13 protrudes outward (refer to FIG. 3B).

Next, as shown in FIG. 5D, the care worker removes the first rail 12 from the first bed mounting units 34, and installs this first rail 12 in the first armrest mounting units 21. This task is a second armrest formation step S03 (refer to FIG. 4A). At this time, the care worker mounts the first rail 12 in the first armrest mounting units 21 in such a manner that the armrest portion 42 of the first rail 12 protrudes outward (refer to FIG. 3B).

When the first rail 12 and the second rail 13 are installed in the first armrest mounting units 21 and the second armrest mounting units 22 by the care worker, lock of the wheelchair 14 to the bed main body portion 15 is cancelled, so that a second separation step S04 for separating the wheelchair 14 from the bed main body portion 15 can be performed. As shown in FIG. 5E, the care worker performs the second separation step S04 so as to separate the wheelchair 14.

By separating the wheelchair 14 from the bed main body portion 15 by the above procedure, a risk of drop-off of the care-receiver 70 is reduced, so that the highly safe bed 11 can be provided.

It should be noted that in the first embodiment, at the time of separating the wheelchair 14 from the bed main body portion 15, the wheelchair 14 cannot be separated in a state that the first rail 12 and the second rail 13 are attached to the first bed mounting units 34 and the second bed mounting units 35. By installing the first rail 12 and the second rail 13 in the respective installment parts of the first armrest mounting units 21 and the second armrest mounting units 22, rails for preventing the fall can be formed on both sides of the wheelchair 14. In such a way, the bed 11 of the first embodiment is a bed with a less risk that the care-receiver 70 is slipped off.

By providing the first armrest mounting units 21 and the second armrest mounting units 22 near the first bed mounting units 34 and the second bed mounting units 35, the care worker can perform the task without leaving the bed 11 even in a state that the care worker changes installment positions of the first rail 12 and the second rail 13. Therefore, the bed 11 of the first embodiment is a bed with which the care worker can perform the task while visually recognizing a state of the care-receiver 70, the bed being capable of reducing the risk of the drop-off of the care-receiver 70.

It should be noted that although the second armrest formation step S03 is performed after the first armrest formation step S02 in the above description, the first armrest formation step S02 may be performed after the second armrest formation step S03. In a case where the first armrest formation step S02 is performed after the second armrest formation step S03 in such a way, at least one of the first rail 12 and the second rail 13 always exists on the side of the first armrest mounting units 21. Therefore, in a case where the first armrest formation step S02 is performed after the second armrest formation step S03 in such a way, the risk of the drop-off of the care-receiver 70 can also be reduced.

It should be noted that any of installment positions of the first rail 12 and the second rail 13 may be changed firstly. That is, in the above description, the first rail 12 and the second rail 13 may be switched with each other.

It should be noted that in a case where the second armrest formation step S03 is performed after the first armrest formation step S02, the care worker can stand in the vicinity of the first armrest mounting units 21 so as to install the second rail 13 in the second armrest mounting units 22. Therefore, when the second armrest formation step S03 is performed after the first armrest formation step S02, the method becomes excellent in care-worker-friendliness.

It should be noted that in a case where the first rail 12 or the second rail 13 can be installed in the second armrest mounting units 22 in the bed state B, the first separation step S01 can be omitted.

It should be noted that when the wheelchair 14 is coupled to the bed main body portion 15, reverse actions to the separating procedure may be performed.

Specific Example of the First Embodiment

FIGS. 18A, 18B, 18C, 18E, 18G are partially sectional views of the bed for illustrating separation of the wheelchair from the bed main body portion according to a specific example of the first embodiment (sectional views of a part corresponding to a part of the line A-A of FIG. 1B). FIGS. 18D and 18F are enlarged sectional views of parts of FIGS. 18C and 18E, respectively. FIGS. 18H to 18L are partially sectional views of the bed for illustrating coupling of the wheelchair to the bed main body portion according to the specific example of the first embodiment (sectional views of the part corresponding to the part of the line A-A of FIG. 1B).

In the specific example of the first embodiment, a locking mechanism and support rod portions of the first and second rails have more specific structures than the above first embodiment. Specifically, instead of lowering a locking projection 57 by the support rod portion 44 as in the above first embodiment, the locking projection 57 is lowered by a support rod portion 44U with a rounded front end in the specific example of the first embodiment. The locking projection 57 and a convex portion 65 are brought into contact with and locked to each other in the above first embodiment, whereas the locking projection 57 is locked to a U shape engagement member 65U arranged in the horizontal direction to the locking projection 57 in the specific example of the first embodiment. Hereinafter, parts in the specific example of the first embodiment, which is different from the above first embodiment will be described.

When the wheelchair 14 is separated from the bed main body portion 15, actions are performed in order of FIGS. 18A, 18B, 18C, 18E, 18G.

Figure 18A:
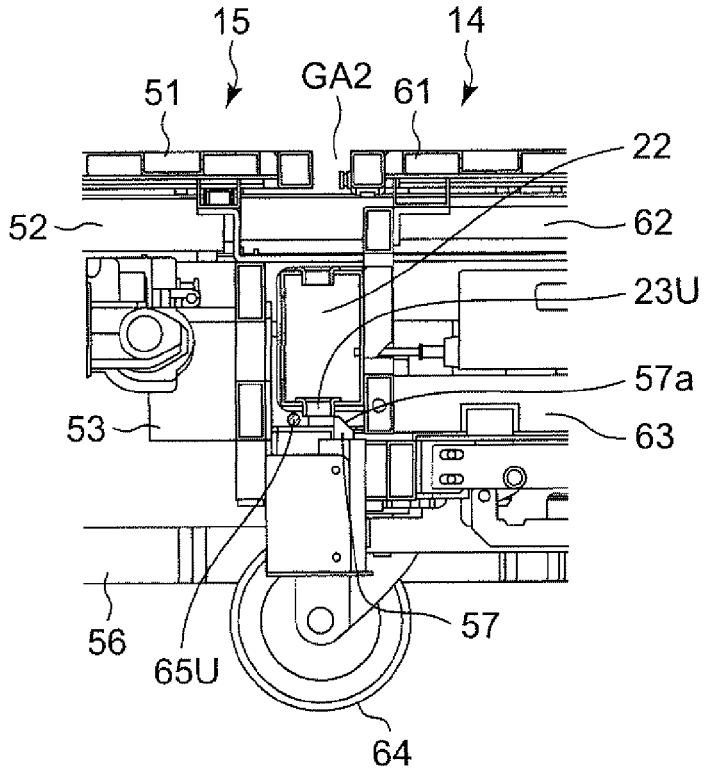
FIG. 18A is a partially sectional view of the bed at the time of slightly separating from coupling (first separation step S01) for illustrating separation of the wheelchair from the bed main body portion according to a specific example of the first embodiment.
Figure 18B:
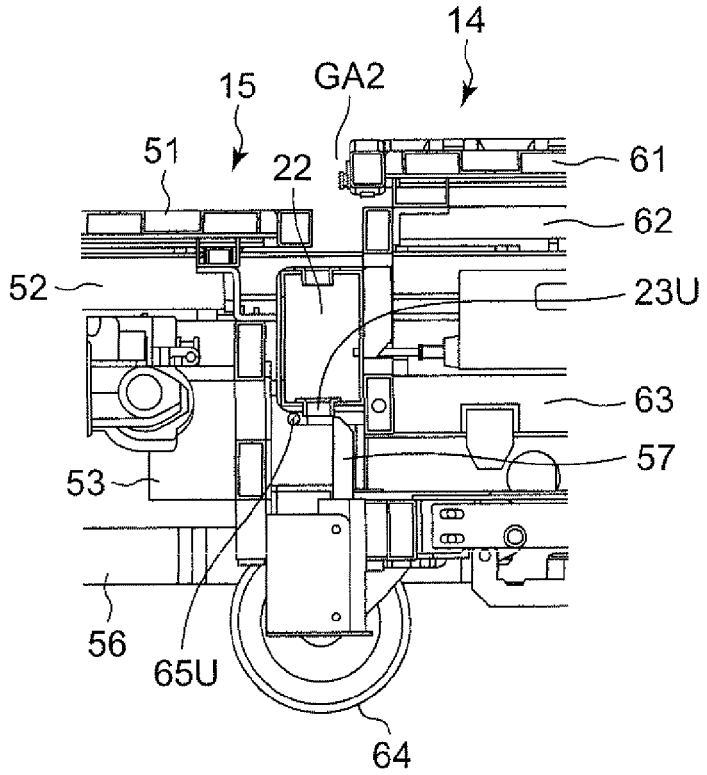
FIG. 18B is a partially sectional view of the bed at the time of lowering the bed main body portion for illustrating the separation of the wheelchair from the bed main body portion according to the specific example of the first embodiment.
Figure 18C:
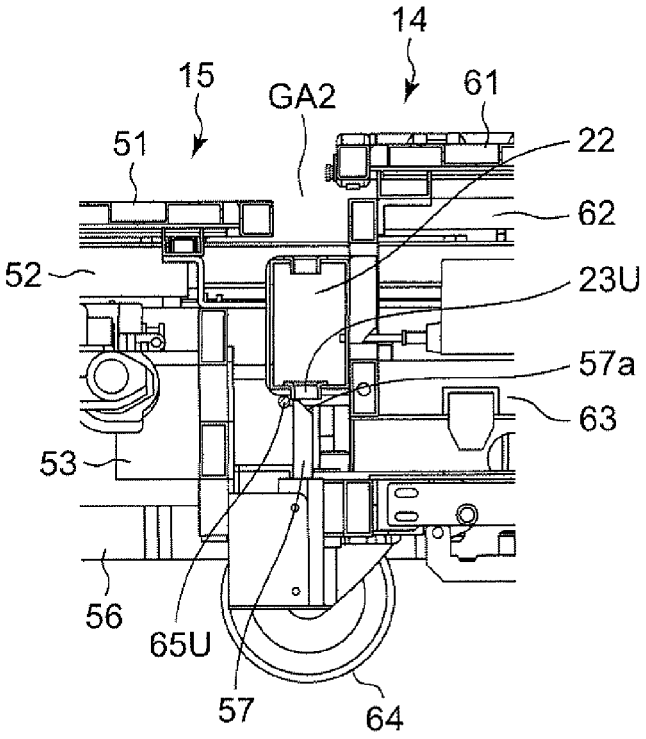
FIG. 18C is a partially sectional view of the bed in the locked state for illustrating the separation of the wheelchair from the bed main body portion according to the specific example of the first embodiment.
Figure 18D:
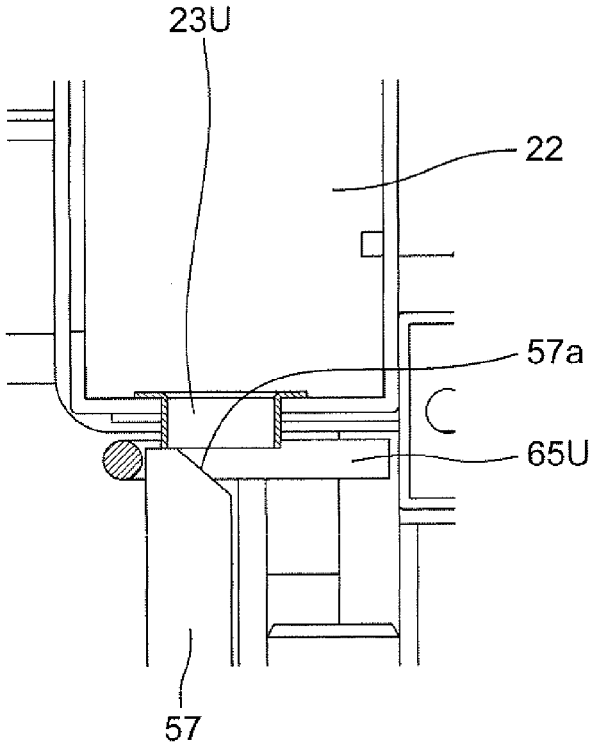
FIG. 18D is an enlarged sectional view of a part of FIG. 18C.

Firstly, as shown in FIG. 18A, in a state that the wheelchair 14 is coupled to the bed main body portion 15 (bed state B), a height of the mat portion 61 of the wheelchair 14 is the same as a height of the mat portion 51 of the bed main body portion 15. When the coupling mechanism portion 56 is lowered by the elevating portion 54 in order to separate the wheelchair 14 and the bed main body portion 15, the state becomes a state shown in FIG. 18B. When the care worker grips the first rail 12 or the like so as to move the first rail 12 in the direction in which the wheelchair 14 is separated from the bed main body portion 15 in this state, as shown in FIGS. 18C and 18D, the locking projection 57 and the U shape engagement member 65U are locked to each other, so that the wheelchair 14 cannot be separated from the bed main body portion 15 anymore. This state is the first separation step S01 of FIG. 4A.

Figure 18E:
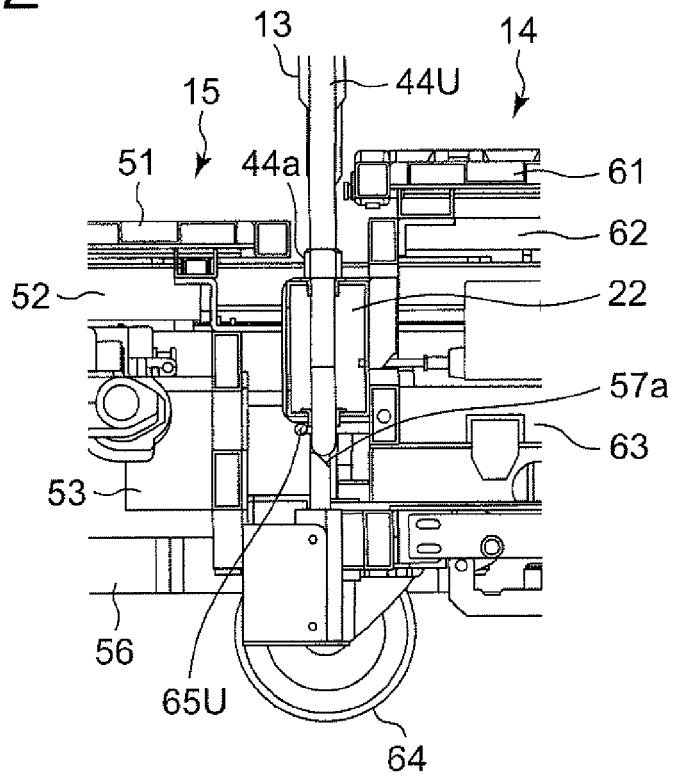
FIG. 18E is a partially sectional view of the bed during cancellation of lock for illustrating the separation of the wheelchair from the bed main body portion according to the specific example of the first embodiment.
Figure 18F:
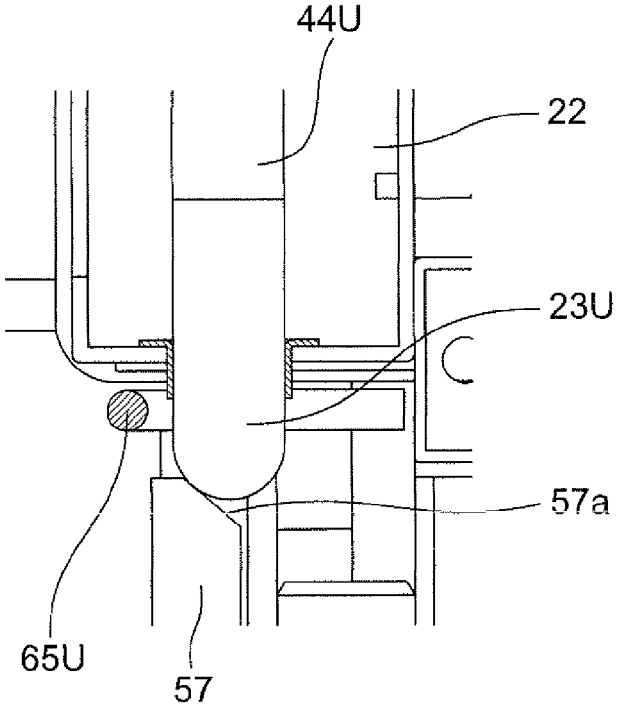
FIG. 18F is an enlarged sectional view of a part of FIG. 18E.
Figure 18G:
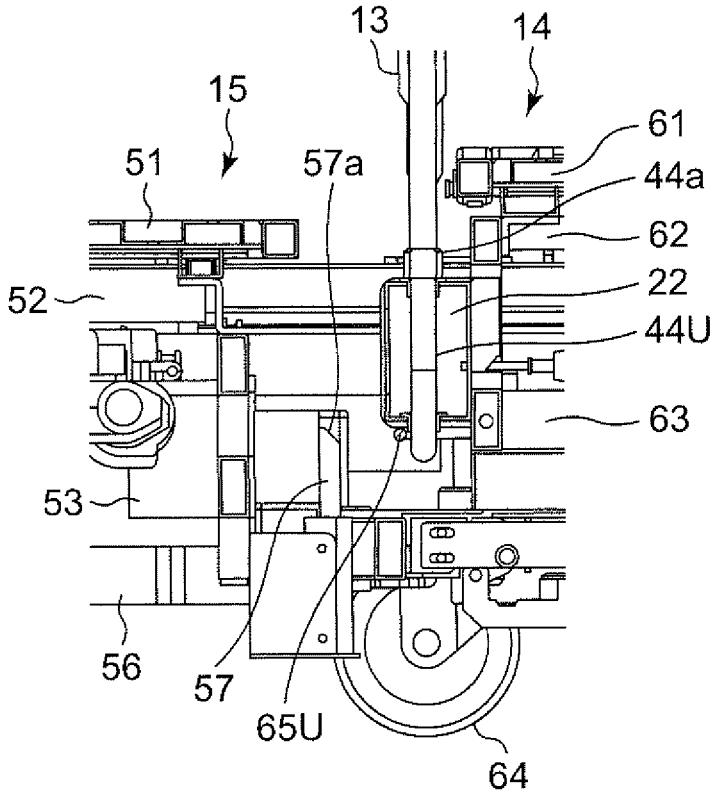
FIG. 18G is a partially sectional view of the bed after the cancellation of the lock for illustrating the separation of the wheelchair from the bed main body portion according to the specific example of the first embodiment.

Next, as shown in FIG. 18E, the care worker installs the second rail 13 in the second armrest mounting units 22. This task is the first armrest formation step S02 of FIG. 4A. As shown in FIGS. 18E and 18F, when the support rod portion 44U of the second rail 13 is brought into an insertion groove 23U of the second armrest mounting unit 22, the second rail 13 is fixed to the second armrest mounting unit 22, and a lower end of the support rod portion 44U passes through the insertion groove 23U of the second armrest mounting unit 22, protrudes from the lower side of the insertion groove 23U, and presses the locking portion 57 downward. The locking portion 57 is pressed by the lower end of the support rod portion 44U so as to press a spring 56*b* placed between the locking portion 57 and a locking portion accommodating recess portion 58, and thus, accommodated in the locking portion accommodating recess portion 58. When the locking portion 57 is accommodated in the locking portion accommodating recess portion 58, the locking portion 57 does not exist in the horizontal direction to the U shape engagement member 65U (in other words, lock of the U shape engagement member 65U and the locking portion 57 is cancelled). As a result, the care worker can largely separate the wheelchair 14 from the bed main body portion 15 in the separating direction (the right direction of FIG. 18G). That is, the lock of the locking projection 57 and the U shape engagement member 65U is cancelled.

Successively, after the second armrest formation step S03 of FIG. 4A is performed, the second separation step S04 of FIG. 4A is performed in order to separate the wheelchair 14 from the bed main body portion 15.

Conversely, when the wheelchair 14 is coupled to the bed main body portion 15, actions are performed in order of FIGS. 18H to 18L.

Figure 18H:
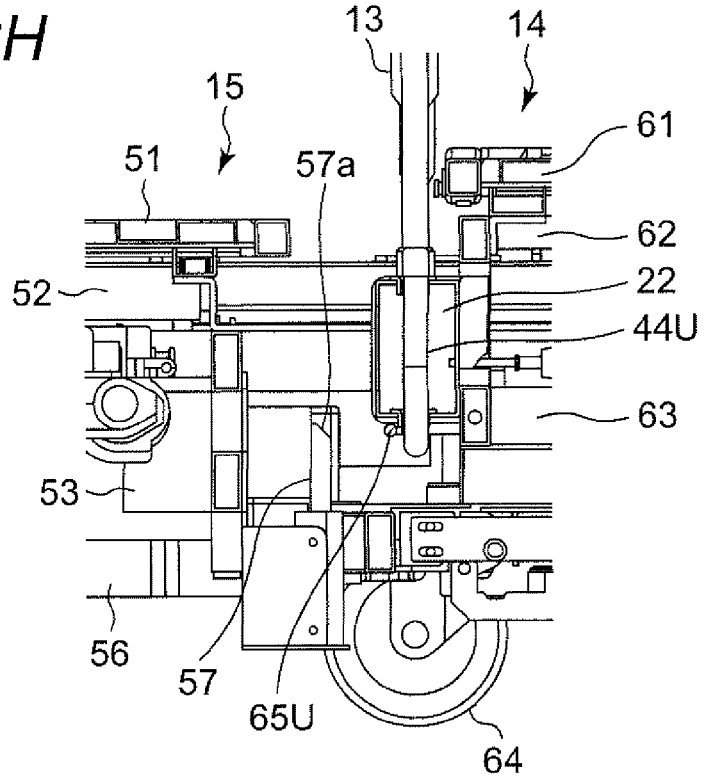
FIG. 18H is a partially sectional view of the bed in the middle of starting coupling for illustrating the separation of the wheelchair from the bed main body portion according to the specific example of the first embodiment.
Figure 18I:
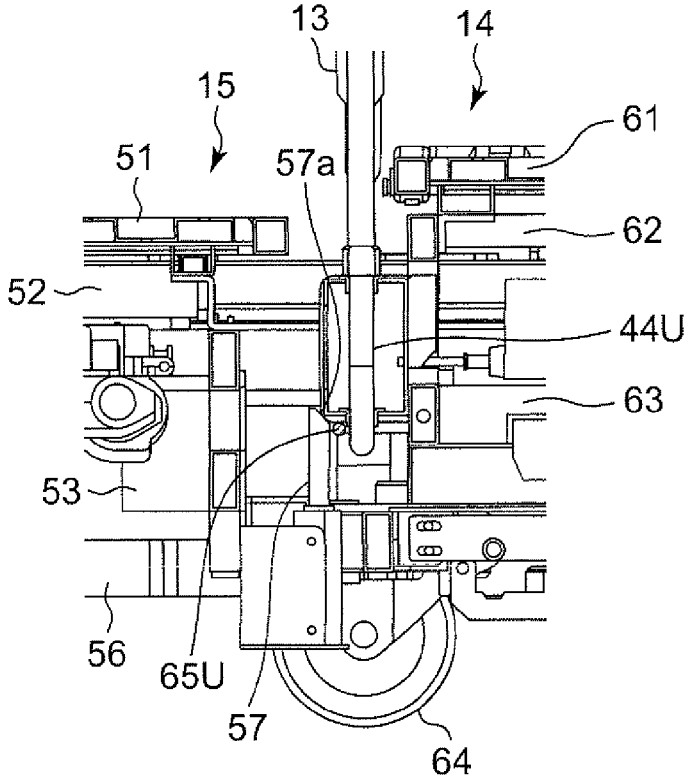
FIG. 18I is a partially sectional view of the bed in the middle of starting the coupling for illustrating the separation of the wheelchair from the bed main body portion according to the specific example of the first embodiment.
Figure 18J:
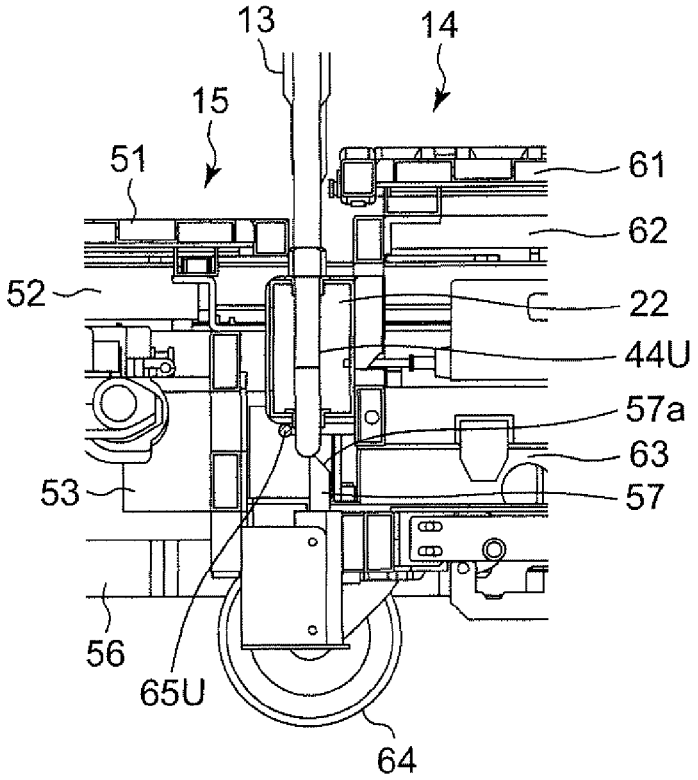
FIG. 18J is a partially sectional view of the bed in the middle of locking for illustrating the separation of the wheelchair from the bed main body portion according to the specific example of the first embodiment.

Firstly, as shown in FIGS. 18H and 18I, when the wheelchair 14 is brought close to the bed main body portion 15, the second armrest mounting unit 22 and the U shape engagement member 65U are brought into contact with an inclined surface 57*a* of the locking projection 57, so as to press the locking projection 57 downward against a bias force of the spring 56*b*. After that, by further moving the wheelchair 14 to the far side in the bed main body portion 15, as shown in FIG. 18J, the lower end of the U shape support rod portion 44U is brought into contact with the inclined surface 57*a* of the locking projection 57, so as to further press the locking projection 57 downward against the bias force of the spring 56*b*.

Figure 18K:
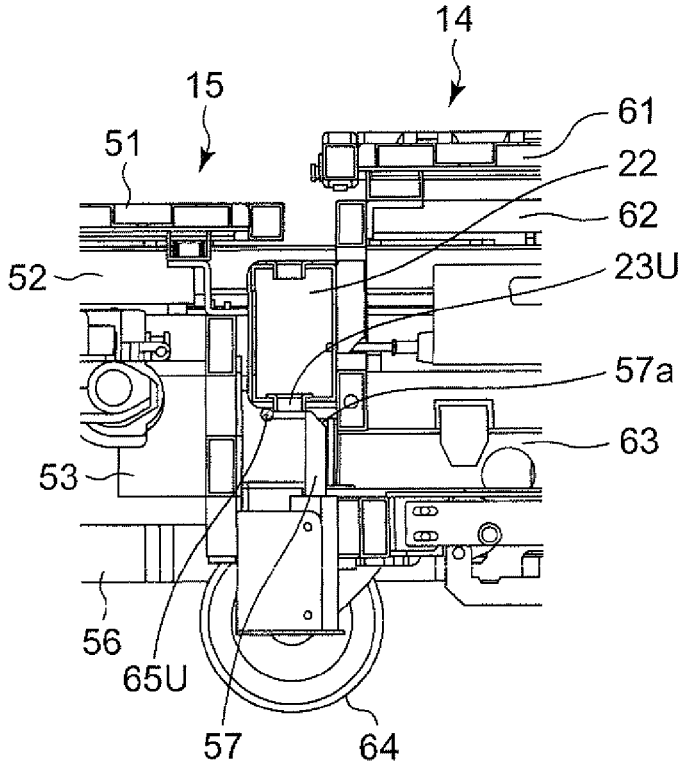
FIG. 18K is a partially sectional view of the bed in the locked state for illustrating the separation of the wheelchair from the bed main body portion according to the specific example of the first embodiment.

Next, the second rail 13 is drawn from the second armrest mounting unit 22 and installed in the second bed mounting unit 35. At this time, by drawing the second rail 13 from the second armrest mounting unit 22, the U shape support rod portion 44U pressing down the locking projection 57 is eliminated. Thus, by the bias force of the spring 56*b*, the locking projection 57 is raised. As a result, as shown in FIG. 18K, an upper end of the locking projection 57 is brought into contact with a lower surface of the second armrest mounting unit 22 around the insertion groove 23U.

Figure 18L:
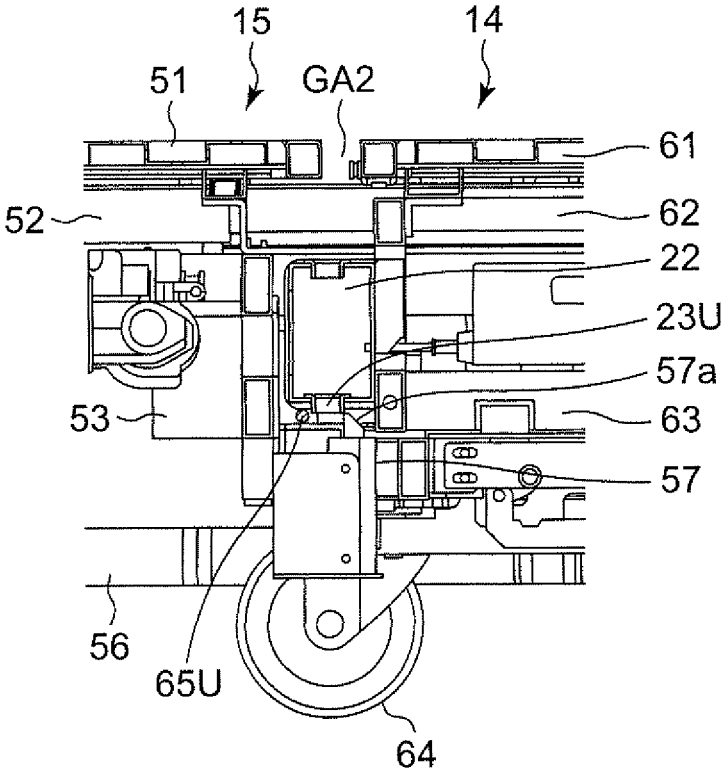
FIG. 18L is a partially sectional view of the bed in the locked state for illustrating the separation of the wheelchair from the bed main body portion according to the specific example of the first embodiment.

Next, when the coupling mechanism portion 56 is raised by the elevating portion 54, the chair base portion 63 of the wheelchair 14 is raised together with the bed base portion 53, the four casters 64 are separated from the bed surface, the chair base portion 63 of the wheelchair 14 is supported by the coupling mechanism portion 56, the height of the mat portion 61 of the wheelchair 14 becomes the same as the height of the mat portion 51 of the bed main body portion 15, and as shown in FIG. 18L, the state becomes the state that the wheelchair is coupled to the bed main body portion 15 (bed state B).

Finally, when the wheelchair 14 is further pressed and moved to the side of the bed main body portion 15 in order to eliminate the gap GA2 between the mat portion 51 and the mat portion 61, the coupling is completed.

Second Embodiment

Figure 6A:
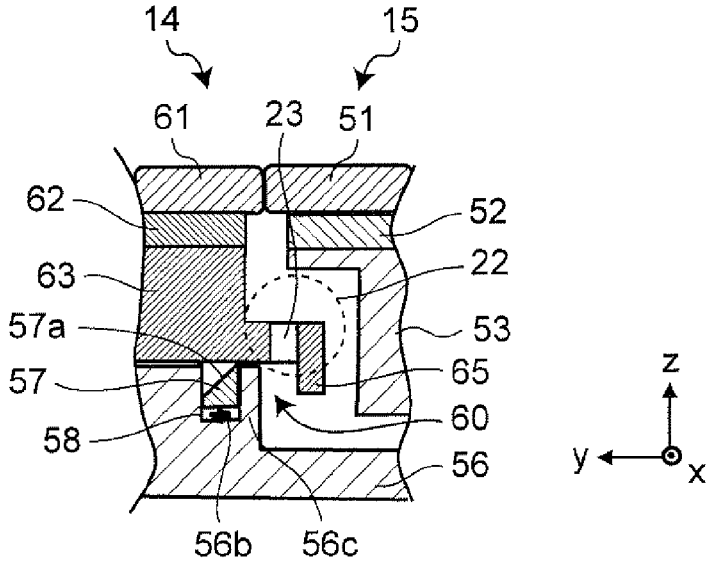
FIG. 6A is a partially sectional view of the bed at the time of coupling for illustrating separation of the wheelchair from the bed main body portion according to the second embodiment.
Figure 6B:
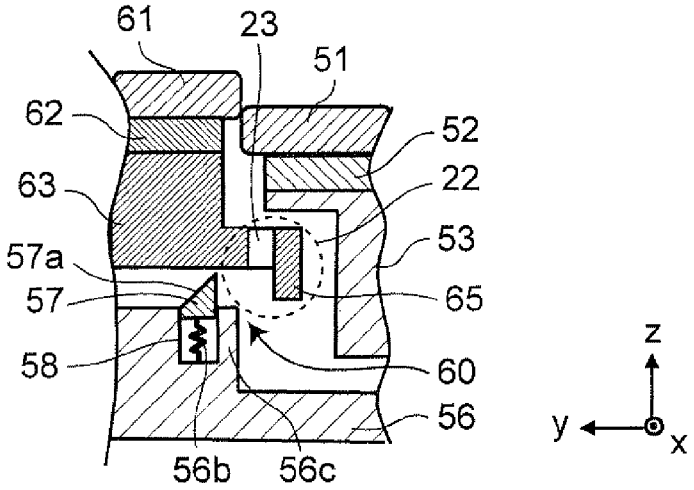
FIG. 6B is a partially sectional view of the bed at the time of lowering the bed main body portion for illustrating the separation of the wheelchair from the bed main body portion according to the second embodiment.
Figure 6C:
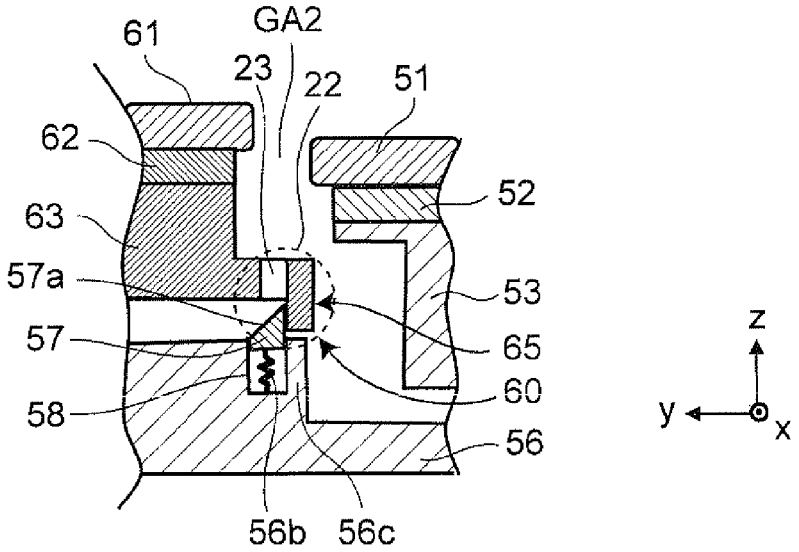
FIG. 6C is a partially sectional view of the bed in the locked state for illustrating the separation of the wheelchair from the bed main body portion according to the second embodiment.
Figure 7:
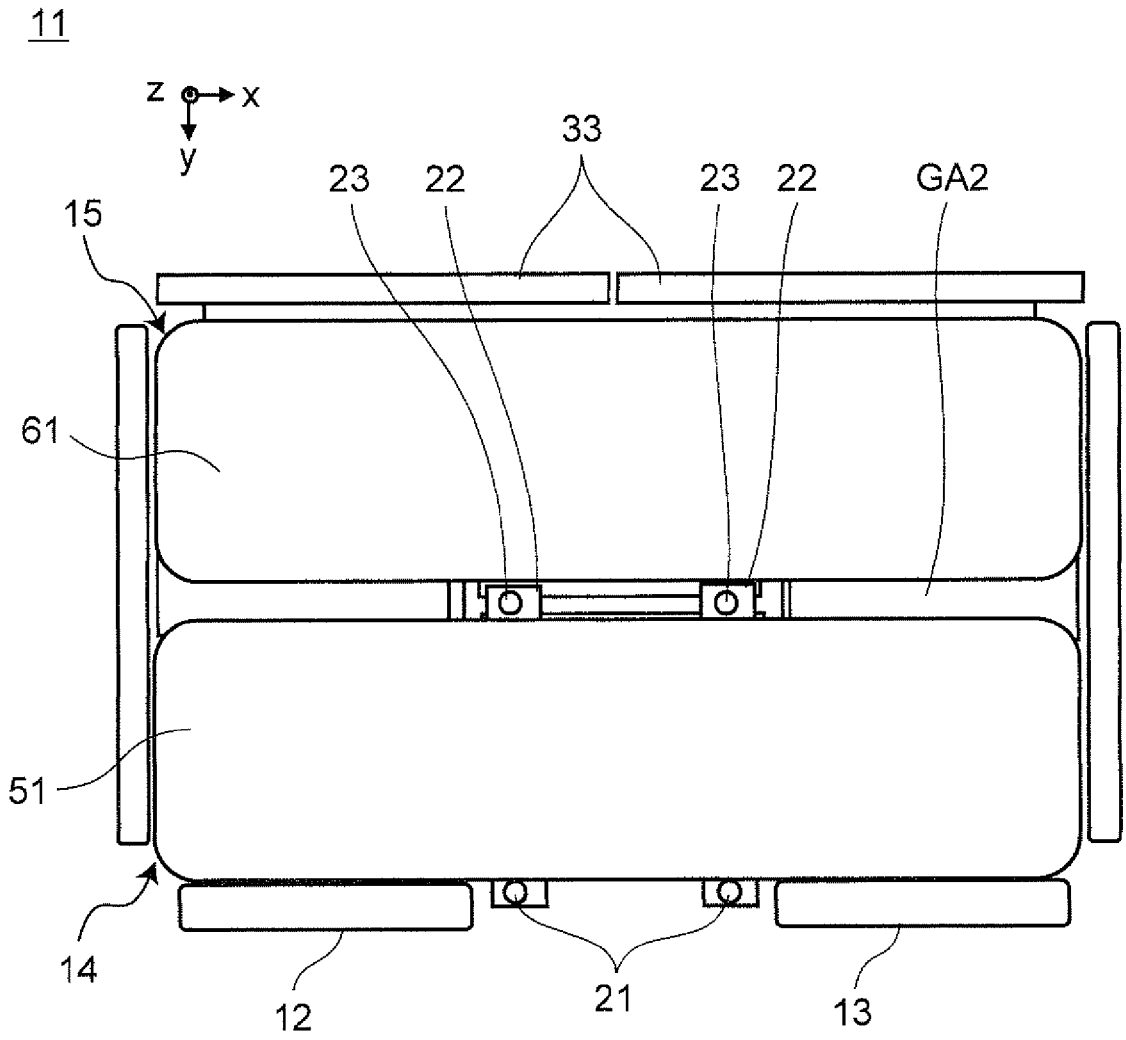
FIG. 7 is a plan view of the bed in the locked state according to the second embodiment.
Figure 8:
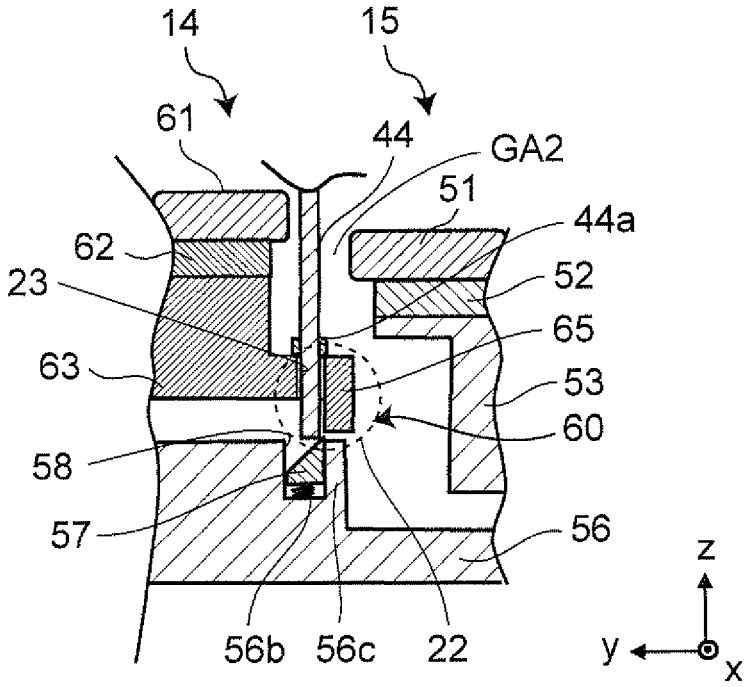
FIG. 8 is a partially sectional view of the bed at the time of separation according to the second embodiment.

FIGS. 6A, 6B, and 6C are views for illustrating separation of the wheelchair 14 from the bed main body portion 15 according to a second embodiment. FIG. 6A is a partially sectional view of the coupling mechanism portion 56 of the bed 11 at the time of coupling the bed main body portion 15 and the wheelchair 14 (sectional view of the part corresponding to the part of the line A-A of FIG. 1B). FIG. 6B is a partially sectional view of the bed 11 at the time of lowering the bed main body portion 15 (sectional view of the part corresponding to the part of the line A-A of FIG. 1B). FIG. 6C is a partially sectional view of the bed 11 in the locked state (sectional view of the part corresponding to the part of the line A-A of FIG. 1B). FIG. 7 is a plan view of the bed 11 in the locked state according to the second embodiment. FIG. 8 is a partially sectional view of the bed 11 at the time of separation according to the second embodiment (sectional view of the part corresponding to the part of the line A-A of FIG. 1B).

Hereinafter, points in which the second embodiment is different from the above first embodiment will be described with reference to the figures.

As shown in FIGS. 6A to 6C, 7, and 8, the bed 11 according to the second embodiment is characterized in that a locking cancellation mechanism 60 for canceling the lock of the wheelchair 14 to the bed 11 is provided in the coupling mechanism portion 56 and the chair base portion 63. In this locking cancellation mechanism 60, by installing the second rail 13 in the second armrest mounting unit 22, the lock of the wheelchair 14 is cancelled.

This locking cancellation mechanism 60 includes the spring 56*b* and the locking projection 57 in the locking portion accommodating recess portion 58, and the convex portion 65 serving as one example of a locking end (locking member) of the second armrest mounting unit 22 of the chair base portion 63.

The locking projection 57 is arranged in the locking portion accommodating recess portion 58 of a second mounting unit engagement portion 56*c* of the coupling mechanism portion 56. This locking projection 57 is biased in the upward-protruding direction by the spring 56*b* functioning as one example of an elastic portion, and retained and arranged. The second mounting unit engagement portion 56*c* is a part of the coupling mechanism portion 56 positioned on the lower side of the pair of second armrest mounting units 22 of the chair base portion 63 when the wheelchair 14 is coupled to the bed main body portion 15. The inclined surface 57*a* inclined obliquely upward in the coupling direction (opposite to the separating direction) of the wheelchair 14 is formed in the upper end of the locking projection 57. The upper end of the locking projection 57 is capable of sliding on a lower surface of the chair base portion 63 serving as a bottom surface of the second armrest mounting unit 22 of the wheelchair 14, and also of being locked to the convex portion 65.

The convex portion 65 is arranged in an outer peripheral part of the insertion hole 23 of the second armrest mounting unit 22, and protrudes downward from the lower surface of the chair base portion 63. This convex portion 65 is to lock the locking projection 57 and the convex portion 65.

The convex portion 65 is formed in such a manner that the locking projection 57 is positioned on the lower side of the insertion hole 23 at the time of coupling the wheelchair 14. At the time of separating the wheelchair 14, the support rod portion 44 of the second rail 13 inserted into the insertion hole 23 passes through the insertion hole 23, and the support rod portion 44 further presses down the locking projection 57 against the bias force of the spring 56*b*, so that lock of the locking projection 57 and the convex portion 65 can be cancelled.

Motion of the locking cancellation mechanism 60 when the wheelchair 14 is coupled to the bed main body portion 15 will be described with using FIGS. 6A to 6C.

Firstly, the wheelchair 14 is moved toward the bed main body portion 15. When the convex portion 65 passes over the locking projection 57, the locking projection 57 once pushed into the locking portion accommodating recess portion 58 by the convex portion 65 protrudes upward from the locking portion accommodating recess portion 58 by the bias force of the spring 56*b* (refer to FIG. 6C). Since the inclined surface 57*a* is formed in the locking projection 57, the convex portion 65 can pass over the locking projection 57 without any resistance at the time of coupling the wheelchair 14. When the wheelchair 14 is moved toward the bed main body portion 15 by a distance of the gap GA2 in this state, the upper end of the locking projection 57 slides on the lower surface of the chair base portion 63 of the wheelchair 14, so that the gap GA2 between the wheelchair 14 and the bed main body portion 15 is eliminated (refer to FIG. 6B). After that, when the bed base portion 53 is raised by the elevating portion 54, the mat portion 51 and the mat portion 61 are flattened, so that the wheelchair 14 and the bed main body portion 15 are coupled (refer to FIG. 6A).

Successively, motion of the locking cancellation mechanism 60 when the wheelchair 14 is separated from the bed main body portion 15 will be described with using FIGS. 6A to 6C.

As shown in FIG. 6A, in a state that the wheelchair 14 is coupled to the bed main body portion 15 (bed state B), the height of the mat portion 61 of the wheelchair 14 is the same as the height of the mat portion 51 of the bed main body portion 15. That is, the mat portion 61 and the mat portion 51 are closely attached to each other.

When the bed base portion 53 is lowered by the elevating portion 54 in order to separate the wheelchair 14 and the bed main body portion 15, the chair base portion 63 of the wheelchair 14 is lowered together with the bed base portion 53, the four casters 64 are brought into contact with the bed surface, and the chair base portion 63 of the wheelchair 14 is separated from the coupling mechanism portion 56. As shown in FIG. 6B, a level difference is generated between the mat portion 61 supported by the four casters 64 via the chair base portion 63 and the mat portion 51 supported by the bed base portion 53. Since the chair base portion 63 is away from the coupling mechanism portion 56 and the four casters 64 are grounded to the bed surface, the care worker can separate the wheelchair 14 from the bed main body portion 15 by the gap GA1 in the separating direction. At this time, in the second embodiment, by bringing and locking the convex portion 65 protruding to the lower side of the second armrest mounting unit 22 into contact with and to the locking portion 57 of the coupling mechanism portion 56, the wheelchair 14 cannot be separated from the bed main body portion 15 by a predetermined distance (that is, by the gap GA1) or more. FIG. 6C shows a state that the convex portion 65 is brought into contact with and locked to the locking portion 57 (that is, the locked state). When the care worker separates the wheelchair 14 from the bed main body portion 15 until the convex portion 65 is brought into contact with and locked to the locking portion 57, as shown in FIG. 6C, the insertion holes 23 of the pair of second armrest mounting units 22 emerge from the gap GA2 between the mat portion 61 and the mat portion 51.

FIG. 7 is a plan view of the bed 11 in the locked state according to the second embodiment. As shown in FIG. 7, in the locked state, the insertion holes 23 of the pair of second armrest mounting units 22 emerge from the gap GA2 between the mat portion 61 and the mat portion 51. In the second embodiment, in such a locked state, the care worker shifts the second rail 13 from the second bed mounting units 35 into the second armrest mounting units 22.

FIG. 8 is a partially sectional view of the bed 11 at the time of the separation according to the second embodiment (sectional view of the part corresponding to the part of the line A-A of FIG. 1B). As shown in FIG. 8, when the support rod portions 44 of the second rail 13 are respectively brought into the insertion holes 23 of the pair of second armrest mounting units 22, the second rail 13 is fixed to the second armrest mounting units 22. At the same time, the lower ends of the support rod portions 44 pass through the insertion holes 23 of the second armrest mounting units 22, protrude from the lower side of the insertion holes 23, and press the locking portion 57 downward. The locking portion 57 is pressed by the lower ends of the support rod portions 44 so as to press the spring 56*b* placed between the locking portion 57 and the locking portion accommodating recess portion 58, and accommodated in the locking portion accommodating recess portion 58. When the locking portion 57 is accommodated in the locking portion accommodating recess portion 58, the locking portion 57 does not exist in the horizontal direction to the convex portion 65 (in other words, the lock of the convex portion 65 and the locking portion 57 is cancelled). As a result, the care worker can largely separate the wheelchair 14 from the bed main body portion 15 in the separating direction (the left direction of FIG. 8).

In such a way, the bed main body portion 15 of the second embodiment has the coupling mechanism portion 56 capable of bringing the wheelchair 14 into the locked state. When the second rail 13 is installed in the second armrest mounting units 22, the coupling mechanism portion 56 for bringing the wheelchair 14 into the locked state cancels the lock of the wheelchair 14.

In the above first embodiment, the first rail 12 and the second rail 13 are used as locking portions at the time of separating the wheelchair 14 from the bed main body portion 15. However, according to a situation, it may be thought that the care worker tries to separate the wheelchair 14 from the bed main body portion 15 in a state that the first rail 12 and the second rail 13 are not inserted into the first bed mounting units 34 and the second bed mounting units 35. With the configuration of the second embodiment, at the time of separating the wheelchair 14 from the bed main body portion 15, the wheelchair 14 cannot be separated unless the second rail 13 is placed in the wheelchair 14 on the side of the bed main body portion 15. Therefore, with the configuration of the second embodiment, at the time of separating the wheelchair 14, the rail for preventing the fall always exists in the wheelchair 14 on the side of the bed main body portion 15. Thus, with the configuration of the second embodiment, at the time of separating the wheelchair 14, even when the body of the care-receiver 70 is slipped in the direction of the bed main body portion 15 by inertia force, the body of the care-receiver 70 can be supported by the second rail 13. In such a way, with the configuration of the second embodiment, the care-receiver 70 is not slipped off on the side of the wheelchair 14 and on the side of the bed main body portion 15, so that the further highly safe bed 11 can be provided.

As described above, the upper end of the locking portion 57 on the side of the wheelchair 14 serves as the inclined surface 57*a*. Thus, when the convex portion 65 and the inclined surface 57*a* of the locking portion 57 are brought into contact with each other at the time of coupling the wheelchair 14 and the bed main body portion 15, the locking portion 57 is pressed against the bias force of the spring 56*b*, and the locking portion 57 is accommodated in the locking portion accommodating recess portion 58. Therefore, at the time of coupling the wheelchair 14, the wheelchair 14 can be coupled without being disturbed by the locking portion 57.

Modification of the First and Second Embodiments

The separating method of the wheelchair 14 from the bed main body portion 15 is not limited to the methods of the first and second embodiments but may be the following method.

Figure 4B:
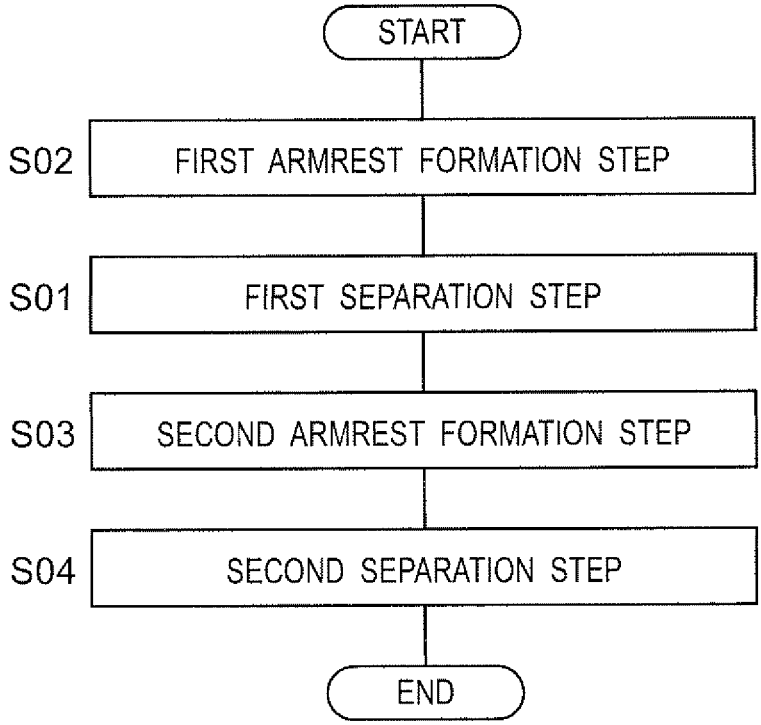
FIG. 4B is a flowchart of a separating method of the wheelchair from the bed main body portion according to a modification of the first embodiment.
Figure 5F:
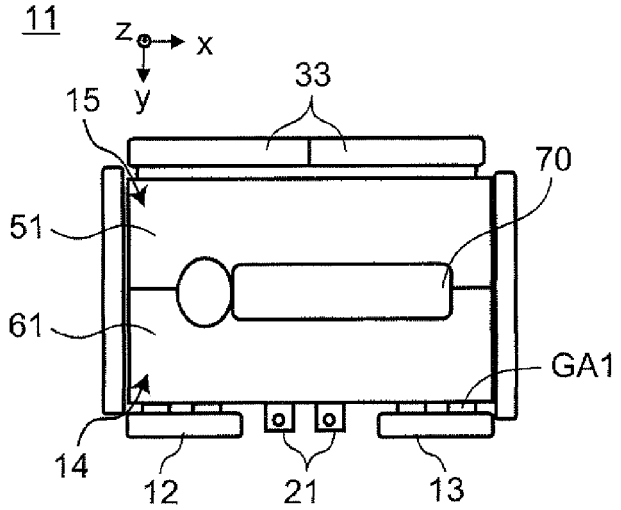
FIG. 5F is a plan view of the bed at the time of coupling for illustrating separation of the wheelchair from the bed main body portion according to the modification of the first and second embodiments.
Figure 5G:
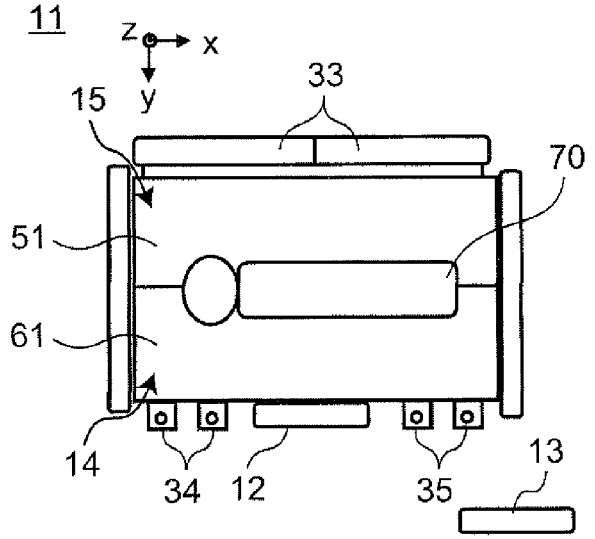
FIG. 5G is a first plan view of the bed in the locked state for illustrating the separation of the wheelchair from the bed main body portion according to the modification of the first and second embodiments.
Figure 5H:
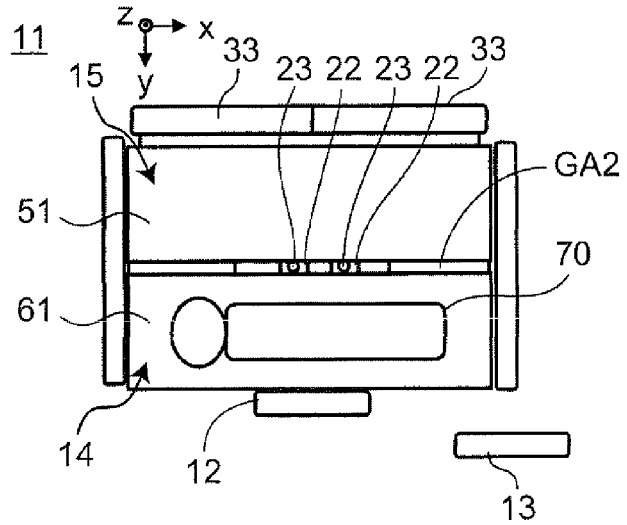
FIG. 5H is a second plan view of the bed in the locked state for illustrating the separation of the wheelchair from the bed main body portion according to the modification of the first and second embodiments.
Figure 5I:
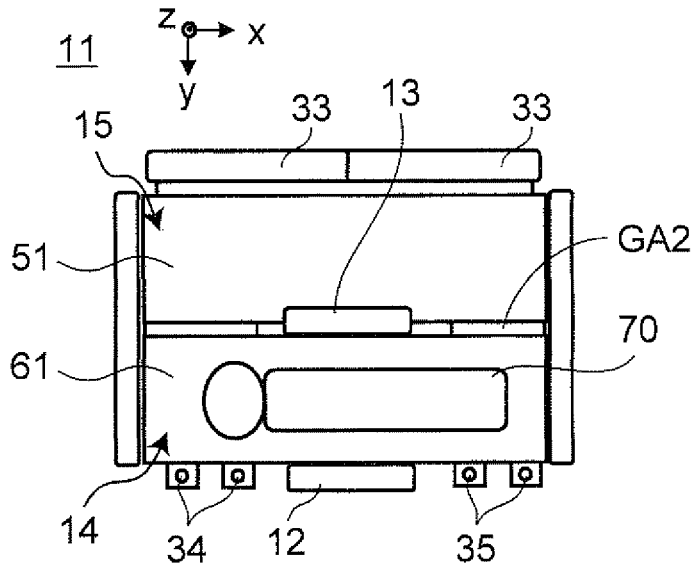
FIG. 5I is a third plan view of the bed in the locked state for illustrating the separation of the wheelchair from the bed main body portion according to the modification of the first and second embodiments.
Figure 5J:
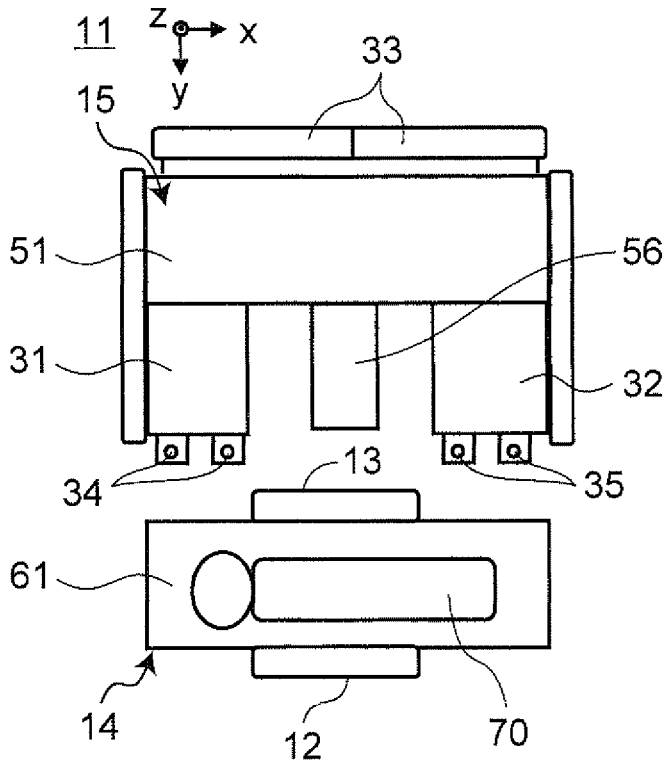
FIG. 5J is a plan view of the bed at the time of separation for illustrating the separation of the wheelchair from the bed main body portion according to the modification of the first and second embodiments.

FIG. 4B is a flowchart of a separating method of the wheelchair 14 from the bed 11 according to a modification of the first and second embodiments. This modification shows the method of separating the wheelchair 14 from the bed main body portion 15 without firstly forming the gap GA2. FIGS. 5F to 5J are views for illustrating separation of the wheelchair 14 from the bed 11 according to the modification of the first and second embodiments. FIG. 5F is a plan view of the bed at the time of coupling. FIG. 5G is a first plan view of the bed in the locked state. FIG. 5H is a second plan view of the bed in the locked state. FIG. 5I is a third plan view of the bed 11 in the locked state. FIG. 5J is a plan view of the bed 11 at the time of separation. With using FIGS. 4B and 5F to 5J, the separating method of the wheelchair 14 from the bed 11 will be described.

The first rail 12 and the second rail 13 are arranged in such a manner that the armrest portions 42 protrude outward in the bed state B (refer to FIG. 5F). This state is the same state as FIG. 5A in which the wheelchair 14 is locked to the bed main body portion 15.

Next, as shown in FIG. 5G, the care worker respectively detaches the first rail 12 and the second rail 13 from the first bed mounting units 34 and the second bed mounting units 35, and installs only the first rail 12 in the first armrest mounting units 21. This task is the first armrest formation step S02 of FIG. 4B. At this time, the care worker mounts the first rail 12 in such a manner that the armrest portion 42 of the first rail 12 protrudes outward. Since the care worker performs a detachment task of the first rail 12 and the second rail 13 and an installment task of the first rail 12 while standing on the one side of the bed 11, the care worker can prevent the care-receiver 70 from falling from the one side of the bed 11.

Next, as in FIG. 5H, the position where the care-receiver 70 lies is changed by the care worker or by the action of the care-receiver 70 himself/herself so that the care-receiver 70 lies only on the mat portion 61 on the side of the wheelchair. After that, when the care worker lowers the bed base portion 53 by the elevating portions 54, the coupling mechanism portion 56 is separated from the chair base portion 63 of the wheelchair 14. When the care worker gripping the first rail 12 moves the wheelchair 14 in the direction in which the wheelchair 14 is separated from the bed main body portion 15 along the width direction of the bed main body portion 15 in this state, the locking projection 57 and the convex portion 65 are locked, so that the gap GA2 is formed between the mat portion 51 and the mat portion 61 (refer to FIG. 5H). The installment parts (insertion holes 23) of the pair of second armrest mounting units 22 hidden by the mat portion 61 are exposed in the gap GA2. This task is the first separation step S01 shown in FIG. 4B.

Next, as shown in FIG. 5I, the care worker installs the second rail 13 in the pair of second armrest mounting units 22. This task is the second armrest formation step S03 of FIG. 4B. At this time, the care worker mounts the second rail 13 in the second armrest mounting units 22 in such a manner that the armrest portion 42 of the second rail 13 protrudes outward. Thereby, the lock of the locking projection 57 and the convex portion 65 is cancelled, and the second separation step S04 for separating the wheelchair 14 from the bed main body portion 15 is enabled. Thus, the second separation step S04 is performed (refer to FIG. 5J).

It should be noted that when the wheelchair 14 is coupled to the bed main body portion 15, reverse actions to the separating procedure may be performed.

With this modification of the first and second embodiments, the wheelchair 14 can be separated or combined by pulling the first rail 12 or the second rail 13 in a state that the care worker holds the first rail 12 or the second rail 13 by hand. In such a way, with the modification of the first and second embodiments, the care worker can easily separate or combine the wheelchair 14.

Third Embodiment

Figure 9:
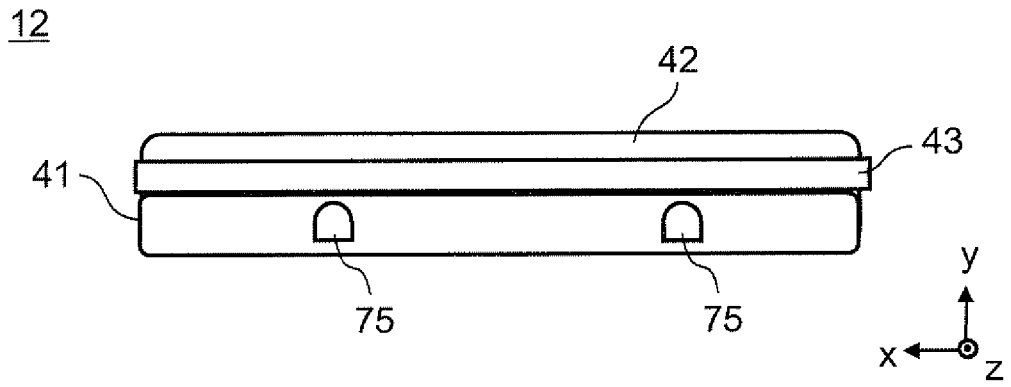
FIG. 9 is a bottom view of the first rail according to a third embodiment of the present invention.
Figure 10:
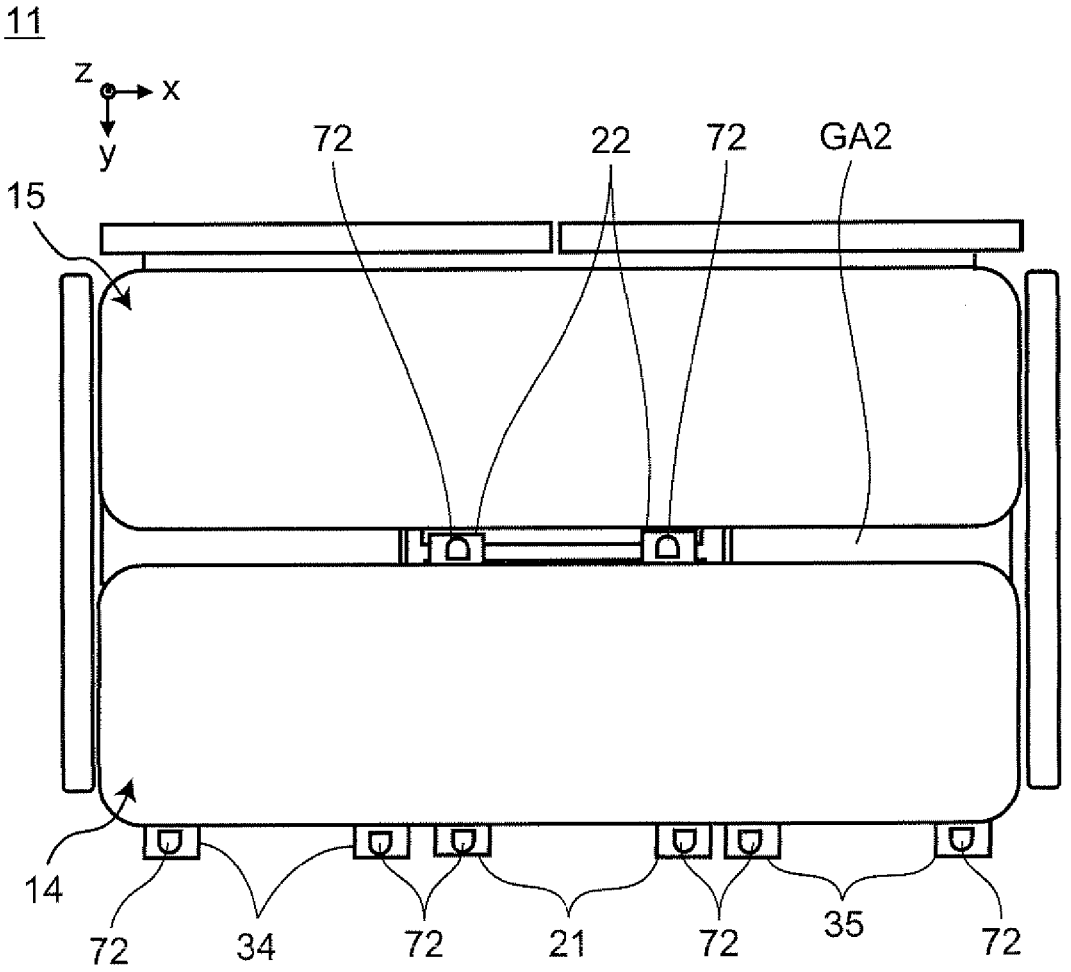
FIG. 10 is a plan view of the bed in the locked state according to the third embodiment.

FIG. 9 is a bottom view of the first rail 12 according to a third embodiment of the present invention. FIG. 10 is a plan view of the bed 11 in the locked state according to the third embodiment.

Hereinafter, points in which the third embodiment is different from the above first embodiment will be described with reference to the figures.

As shown in FIGS. 9 and 10, the bed 11 according to the third embodiment is characterized in that both a shape of the insertion holes 23 and a sectional shape of support rod portions 75 provided instead of the support rod portions 44 of the first rail 12 and the second rail 13 have directionality. By making both the shape of the insertion holes 23 and the sectional shape of the support rod portions 75 have the directionality, the respective armrest portions 42 of the first rail 12 and the second rail 13 can always protrude to the outer side of the bed 11.

Insertion holes 72 are respectively formed in the first armrest mounting units 21, the second armrest mounting units 22, the first bed mounting units 34, and the second bed mounting units 35. The insertion holes 72 each have a non-point symmetrical shape with respect to center thereof, and the sectional shape of the support rod portions 75 of the first rail 12 and the second rail 13 have the same shape as the shape of the insertion holes 72.

For example, the insertion holes 72 are formed in a D shape (shape in which one side of a square on the outer side is formed in an arc shape) as shown in FIG. 10. Similarly, the sectional shape of the support rod portions 75 is formed in a D shape as shown in FIG. 9. In the first rail 12, the side where a width of the support rod portions 75 is narrow (side of the arc shape side) is the protruding direction of the armrest portion 42. In the first bed mounting units 34, the second bed mounting units 35, and the first armrest mounting units 21, the side where a width of the insertion holes 72 is narrow (side of the arc shape side) is respectively the direction opposite to the bed main body portion 15. Similarly, in the second armrest mounting units 22, the side where width of the insertion holes 72 is narrow (side of the arc shape side) is the direction opposite to the wheelchair 14.

With this configuration, the first rail 12 of the third embodiment can be inserted into the insertion holes 72 only in a case where a protruding point of the armrest portion 42 to the first armrest mounting units 21 is set in the predetermined direction. In such a way, by forming the shape of the insertion holes 72 in such a manner that the protruding direction of the armrest portion 42 of the first rail 12 is set toward the outer side of the wheelchair 14, the care worker can install the first rail 12 in the first armrest mounting units 21 without making a mistake in the protruding direction of the armrest portion 42.

It should be noted that although a case of the first rail 12 is described above, the care worker does not make a mistake in the protruding direction of the armrest portion 42 regarding the second rail 13 as well.

Fourth Embodiment

Figure 11A:
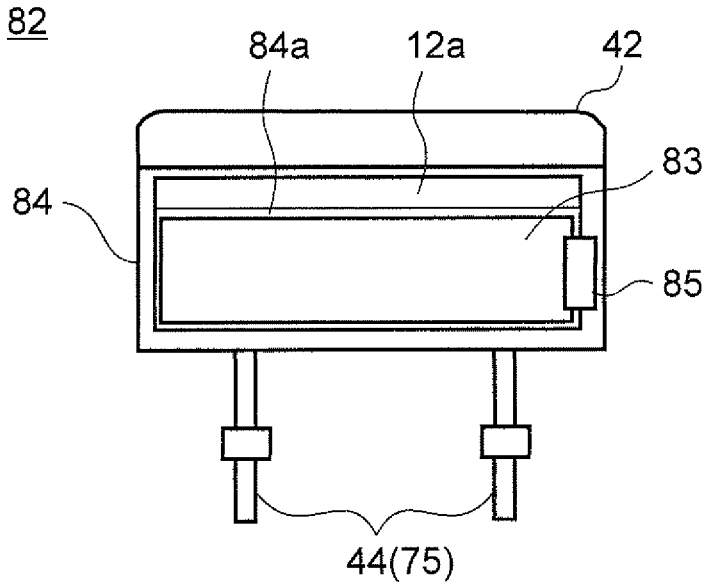
FIG. 11A is a side view of a first rail according to a fourth embodiment of the present invention, with the first rail being in a folded state.
Figure 11B:
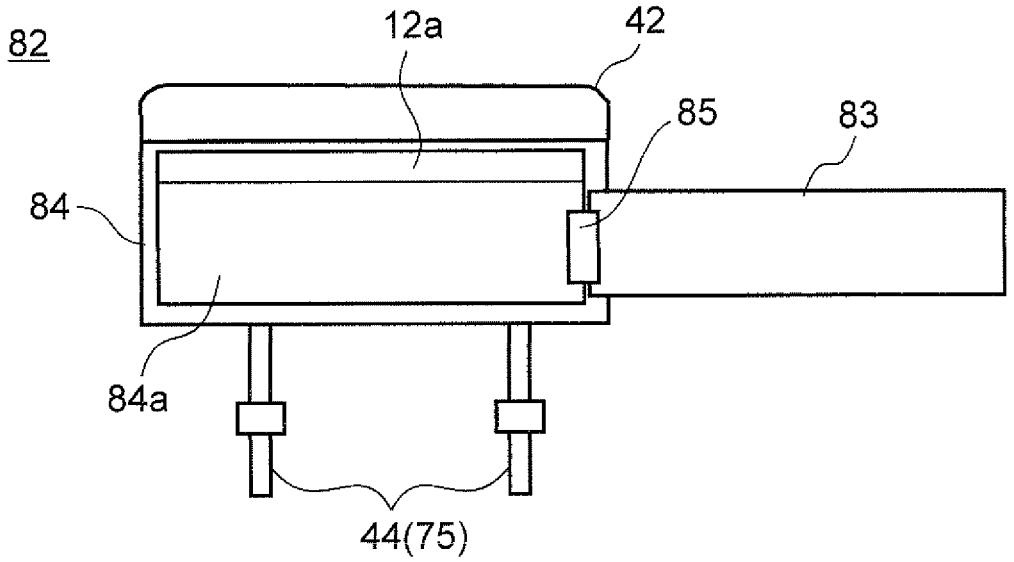
FIG. 11B is a side view of the first rail according to the fourth embodiment of the present invention, with the first rail being in an extended state.

FIGS. 11A and 11B are views showing a first rail 82 according to a fourth embodiment of the present invention. FIG. 11A is a side view of the first rail 82 when an auxiliary rail portion 43 is folded in a support body 84. FIG. 11B is a side view of the first rail 82 when the auxiliary rail portion 43 is opened outward from the support body 84 to a maximum extent.

Hereinafter, points in which the fourth embodiment is different from the above first embodiment will be described with reference to the figures. As shown in FIGS. 11A and 11B, the first rail 82 in the bed 11 has the support body 84, a rotation hinge portion 85 provided in the support body 84, and the auxiliary rail portion 83 rotated about the rotation hinge portion 85. The first rail 82 is composed of rotatably attaching the auxiliary rail portion 83 serving as a plate portion formed in a rectangular plate shape to one side support rod of the support body 84 formed in a quadrilateral frame via the rotation hinge portion 85. It should be noted that a plate portion 84*a* is arranged in the support body 84.

After the wheelchair 14 is coupled to the bed main body portion 15 in a state that the auxiliary rail portion 83 is folded in the support body 84 via the rotation hinge portion 85, the auxiliary rail portion 83 is rotated about the rotation hinge portion 85, so that the auxiliary rail portion 83 is opened from the support body 84. In such a way, the auxiliary rail portion 83 and the support body 84 can be placed in line substantially in a straight form, so that a gap between the first rail 82 and the second rail 13 can be shortened.

In such a way, a space between the first rail 82 and the second rail 13 can be reduced, so that the further highly safe bed can be provided.

Figure 12:
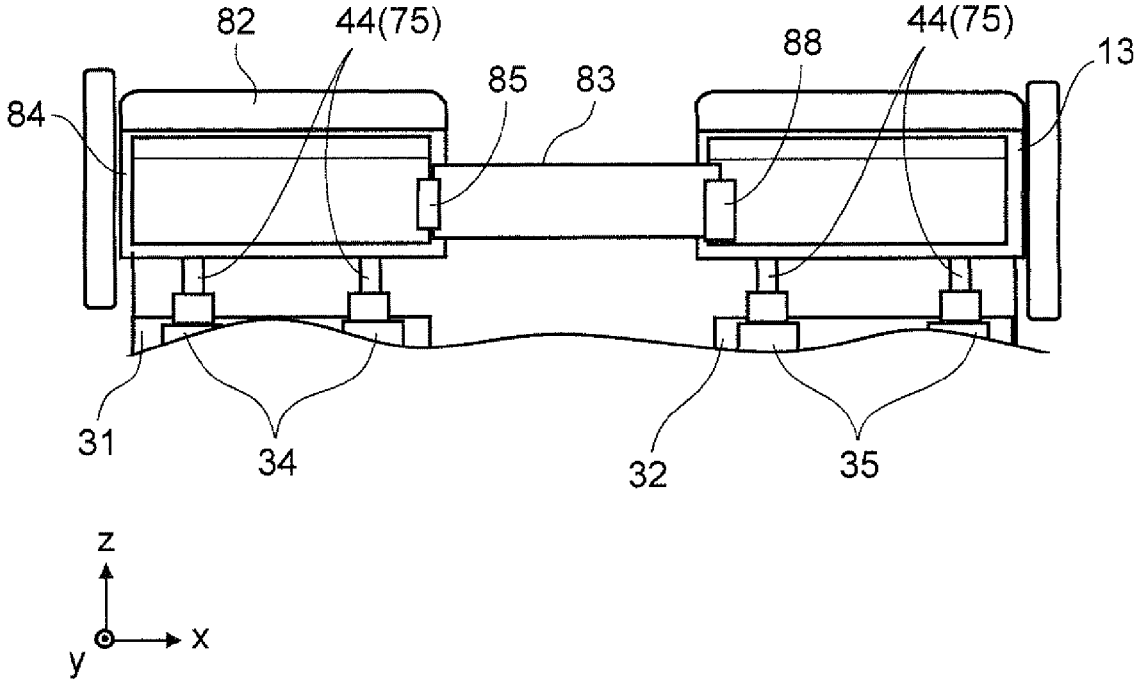
FIG. 12 is a side view of major parts of the bed according to the fourth embodiment.

FIG. 12 is a side view of the bed 11 according to a modification of the fourth embodiment. As shown in FIG. 12, in a case where the wheelchair 14 is coupled to the bed main body portion 15, the first rail 82 and the second rail 13 may be coupled by the auxiliary rail portion 83 by rotating the auxiliary rail portion 83 about the rotation hinge portion 85 and coupling a free end of the auxiliary rail portion 83 to a coupling portion 88 of a support rod in a side part of the second rail 13. With this configuration, the auxiliary rail portion 83 is supported from both sides by the support body 84 and the second rail 13. Thus, the auxiliary rail portion 83 can be firmly supported, so that the further highly safe bed can be provided.

It should be noted that although the first rail 82 is used instead of the first rail 12, a second rail in which a position of the rotation hinge portion 85 is arranged on the second rail side may be used instead of the second rail 13.

Fifth Embodiment

Figure 13A:
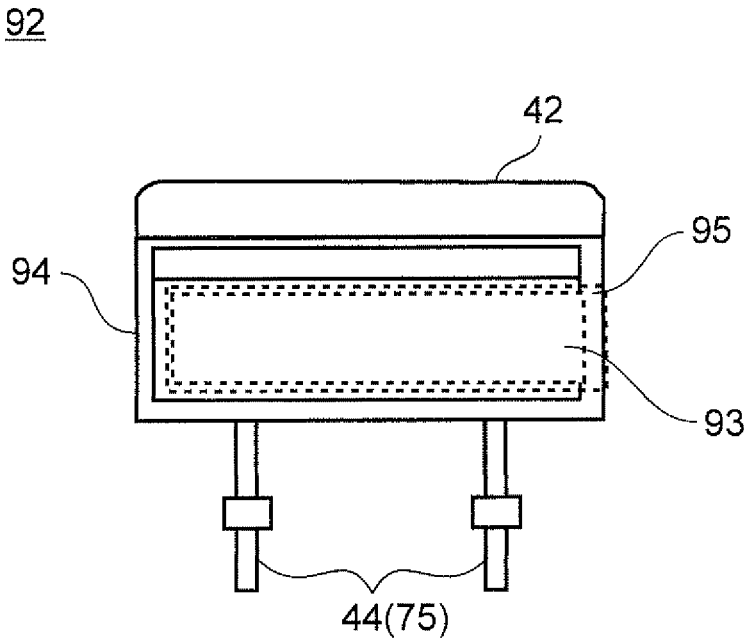
FIG. 13A is a side view of a first rail according to a fifth embodiment of the present invention, with the first rail being in an accommodated state.
Figure 13B:
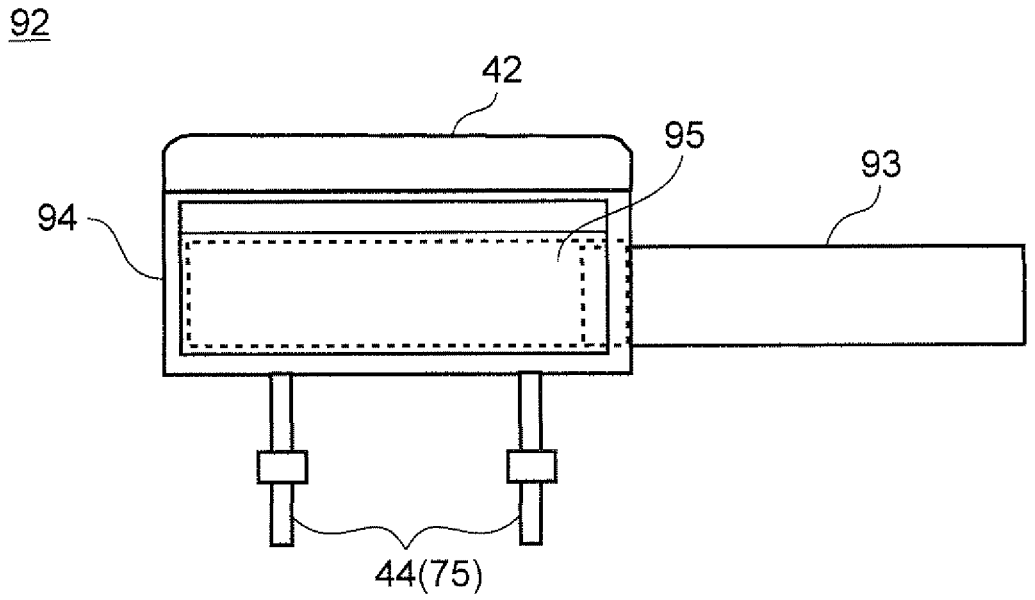
FIG. 13B is a side view of the first rail according to the fifth embodiment of the present invention, with the first rail being in a pull-out state.

FIGS. 13A and 13B are views showing a first rail 92 according to a fifth embodiment of the present invention. FIG. 13A is a side view of the first rail 92 in an accommodated state. FIG. 13B is a side view of the first rail 92 in a pull-out state.

Hereinafter, points in which the fifth embodiment is different from the above first embodiment will be described with reference to the figures. As shown in FIGS. 13A and 13B, the first rail 92 in the bed 11 has a support body 94 formed in a quadrilateral frame, a slide portion 95 provided in the support body 94, and an auxiliary rail portion 93. The auxiliary rail portion 93 is engaged with the slide portion 95 so as to move the slide portion 95 sideways. In the first rail 92, the auxiliary rail portion 93 can be moved rightward in FIG. 13A from the slide portion 95 via a gap in the thickness direction of the support body 94 and extended as in FIG. 13B, and the auxiliary rail portion 93 can be moved leftward in FIG. 13B from the slide portion 95 via the gap in the thickness direction of the support body 94, so that the auxiliary rail portion 93 can be accommodated in the slide portion 95 of the support body 94 as in FIG. 13A.

After the wheelchair 14 is coupled to the bed main body portion 15, by pulling out the auxiliary rail portion 93 rightward in FIG. 13A from the slide portion 95, a gap between the first rail 92 and the second rail can be shortened.

In such a way, a space between the first rail 92 and the second rail is reduced. Thus, the further highly safe bed 11 can be provided.

Figure 14:
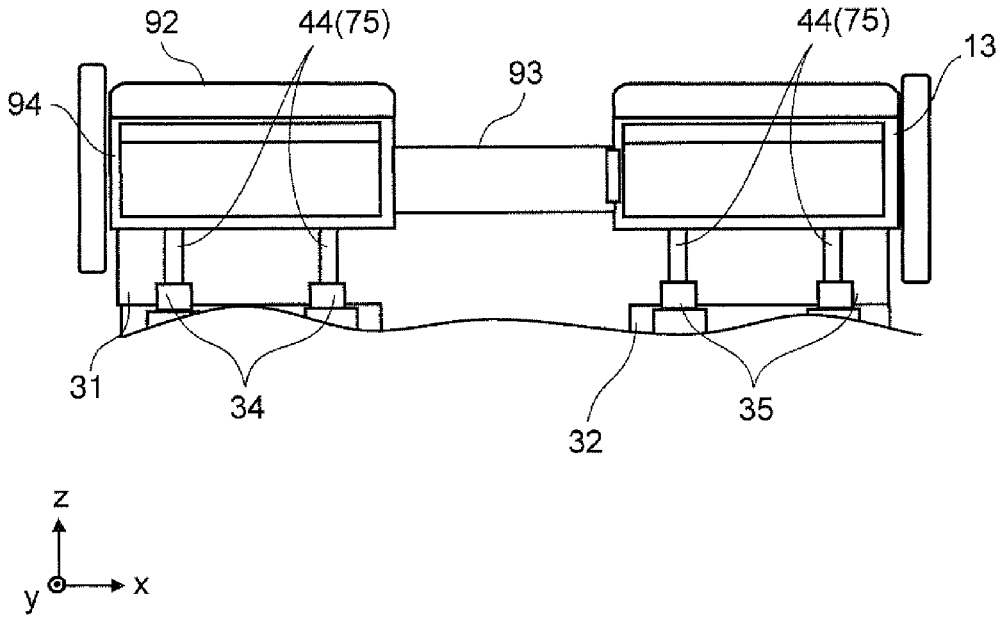
FIG. 14 is a side view of major parts of the bed according to the fifth embodiment.

FIG. 14 is a side view of the bed 11 according to the fifth embodiment. As shown in FIG. 14, after the wheelchair 14 is coupled to the bed main body portion 15, the auxiliary rail portion 93 may be pulled out from the slide portion 95, so that the first rail 92 and the second rail 13 are coupled. With this configuration, the auxiliary rail portion 93 is supported from both sides by the support body 84 of the first rail 92 and the second rail 13. Thus, the auxiliary rail portion 93 can be firmly supported, so that the further highly safe bed can be provided.

It should be noted that although the first rail 92 is used instead of the first rail 12, a second rail in which the sliding direction of the slide portion 95 is reversed may be used instead of the second rail 13.

Sixth Embodiment

Figure 15A:
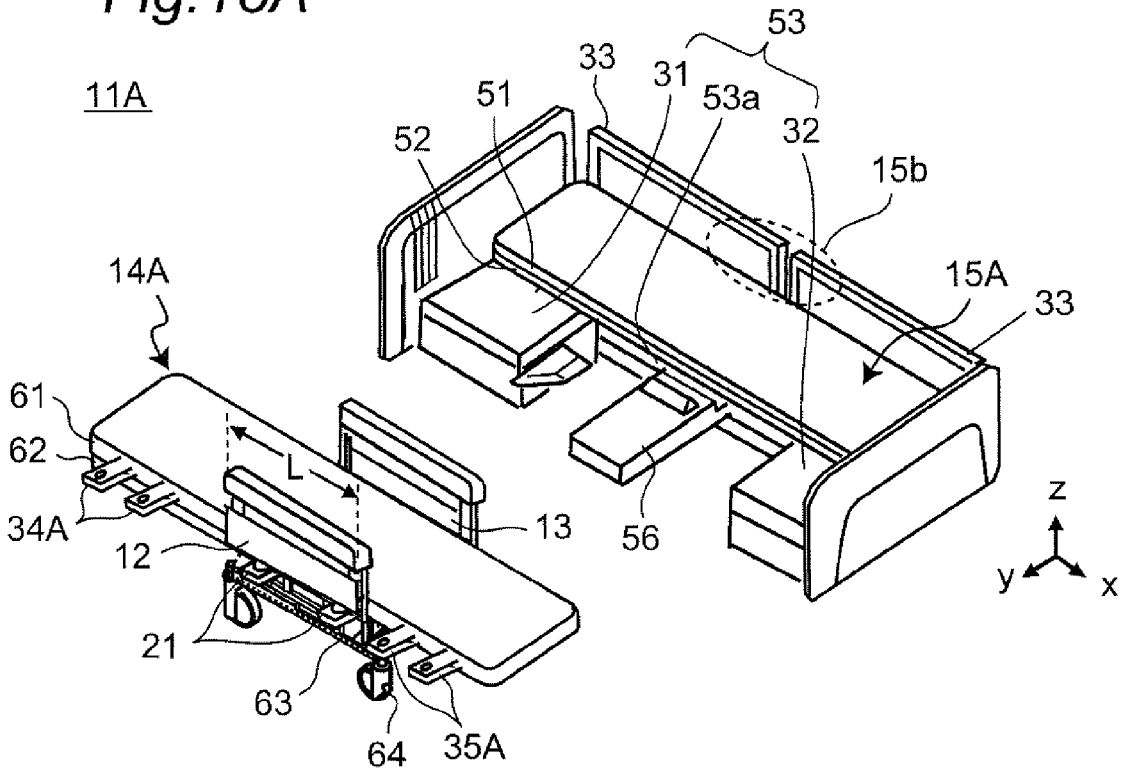
FIG. 15A is a perspective view of a bed in the separated state for illustrating the bed according to a sixth embodiment of the present invention.
Figure 15B:
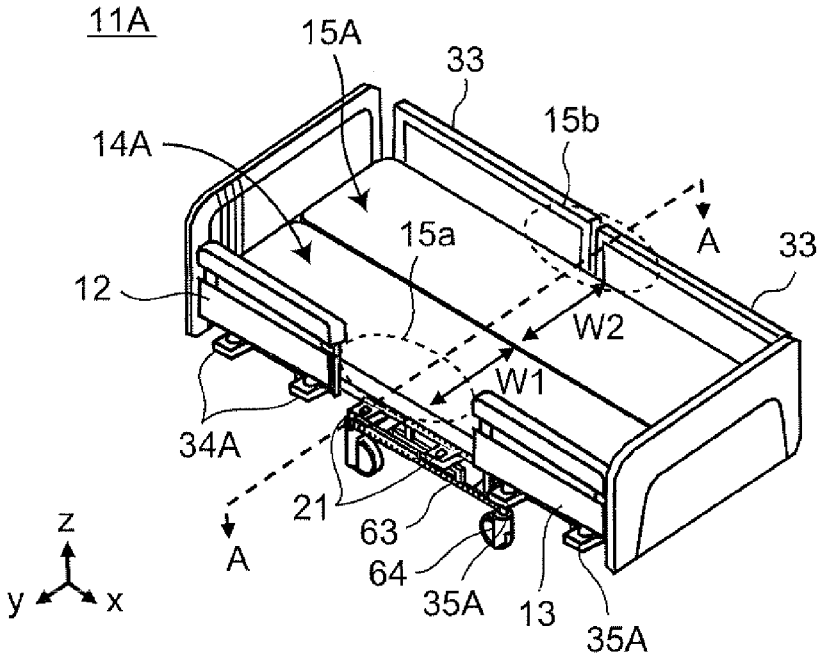
FIG. 15B is a perspective view of the bed in the coupled state for illustrating the bed according to the sixth embodiment of the present invention.
Figure 15C:
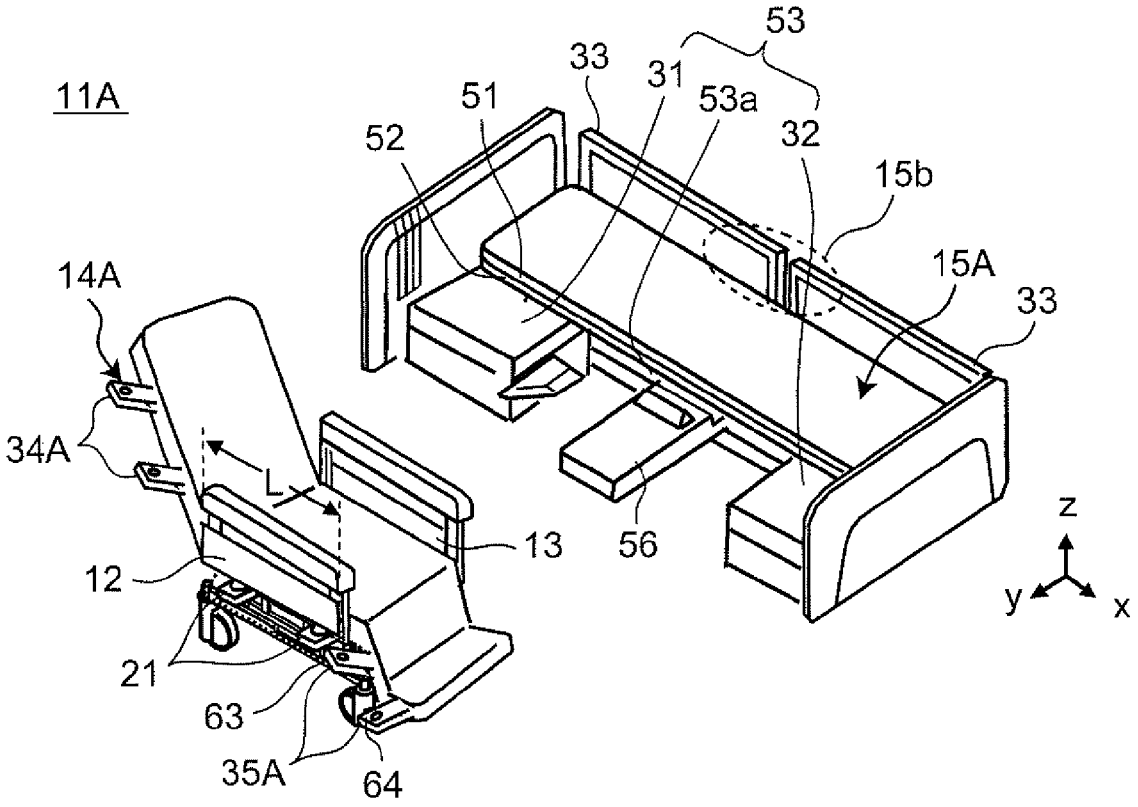
FIG. 15C is a perspective view of the bed in the wheelchair state for illustrating the bed according to the sixth embodiment of the present invention.
Figure 16:
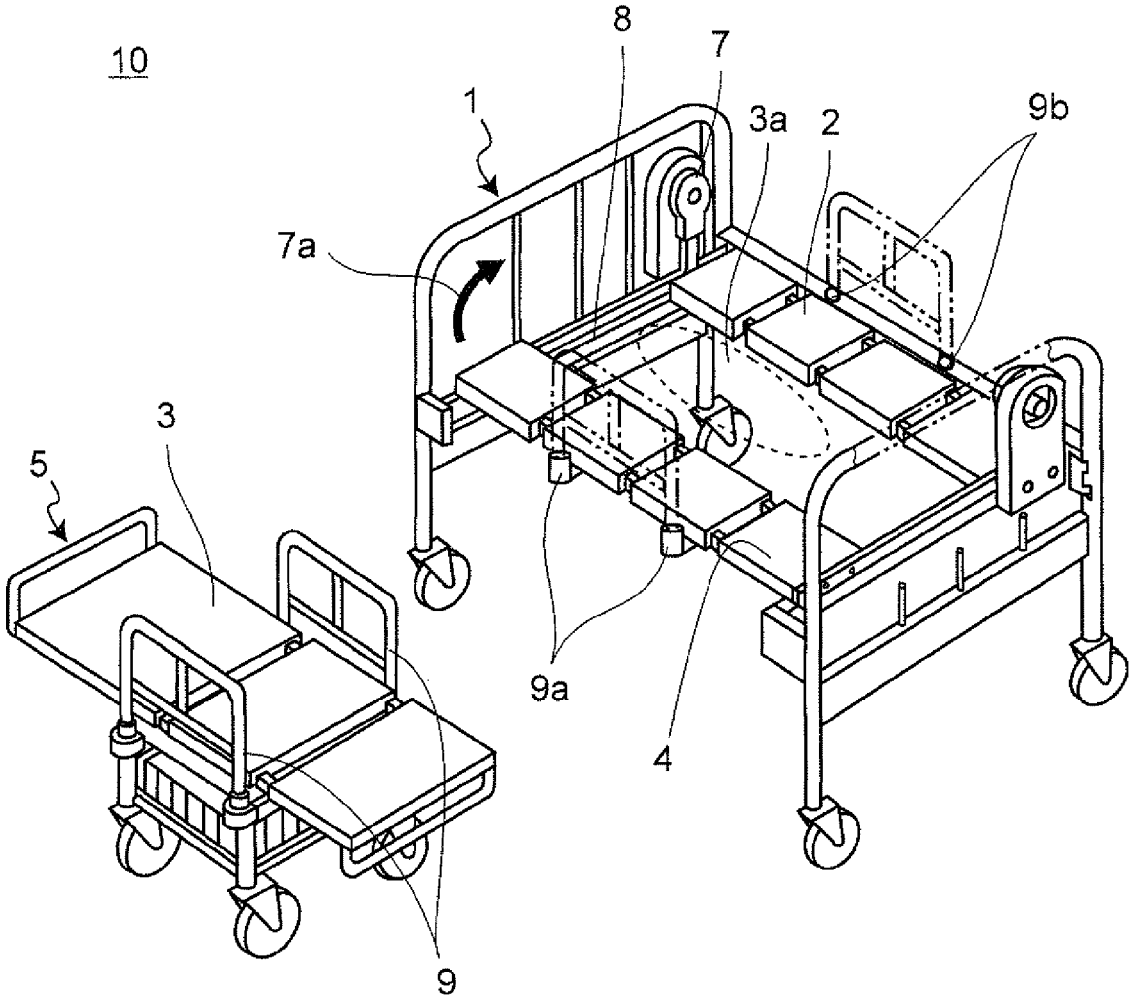
FIG. 16 is a perspective view of a conventional bed.

FIGS. 15A to 15C are perspective views of a bed 11A according to a sixth embodiment of the present invention.

The bed 11A is characterized in that first bed mounting units 34A and second bed mounting units 35A are provided in a wheelchair 14A.

Hereinafter, points in which the sixth embodiment is different from the above first embodiment will be described with reference to the figures.

As shown in FIGS. 15A to 15C, the bed 11A has the first rail 12, the second rail 13, the wheelchair 14A, and a bed main body portion 15A. The bed main body portion 15A has the pair of bed rails 33 on one side.

The wheelchair 14A has the first armrest mounting units 21 to and from which the first rail 12 is attached and detached in a center part of one side part, and has the second armrest mounting units 22 to and from which the second rail 13 is attached and detached in a center part of the other side part. Further, the wheelchair has the first bed mounting units 34A to and from which the first rail 12 is attached and detached on the head side of the side part where the first armrest mounting units 21 exist, and also has the second bed mounting units 35A to and from which the second rail 13 is attached and detached on the leg side of the side part where the first armrest mounting units 21 exist.

At the time of coupling the wheelchair 14A to the bed main body portion 15A, the wheelchair 14A and the bed main body portion 15A are coupled by making the second armrest mounting units 22 and the bed main body portion 15A face each other.

In the sixth embodiment, when the first rail 12 is installed in the first bed mounting units 34A and the second rail 13 is installed in the second bed mounting units 35A, the first rail 12 and the second rail 13 are placed in line on one side of the bed 11A. The one side of the bed 11A is surrounded by the first rail 12 and the second rail 13. Therefore, a space in front and back of the first rail 12 and the second rail 13 is narrowed. Thus, even when the care-receiver moves the body toward the side of the first rail 12 and the second rail 13, the body of the care-receiver can be supported by the first rail 12 and the second rail 13, so that the highly safe bed can be provided. When the first rail 12 and the second rail 13 are respectively detached and then installed, the rails can be immediately installed without placing the first rail 12 and the second rail 13 on the floor. Thus, the task can be efficiently performed.

Seventh Embodiment

Figure 17A:
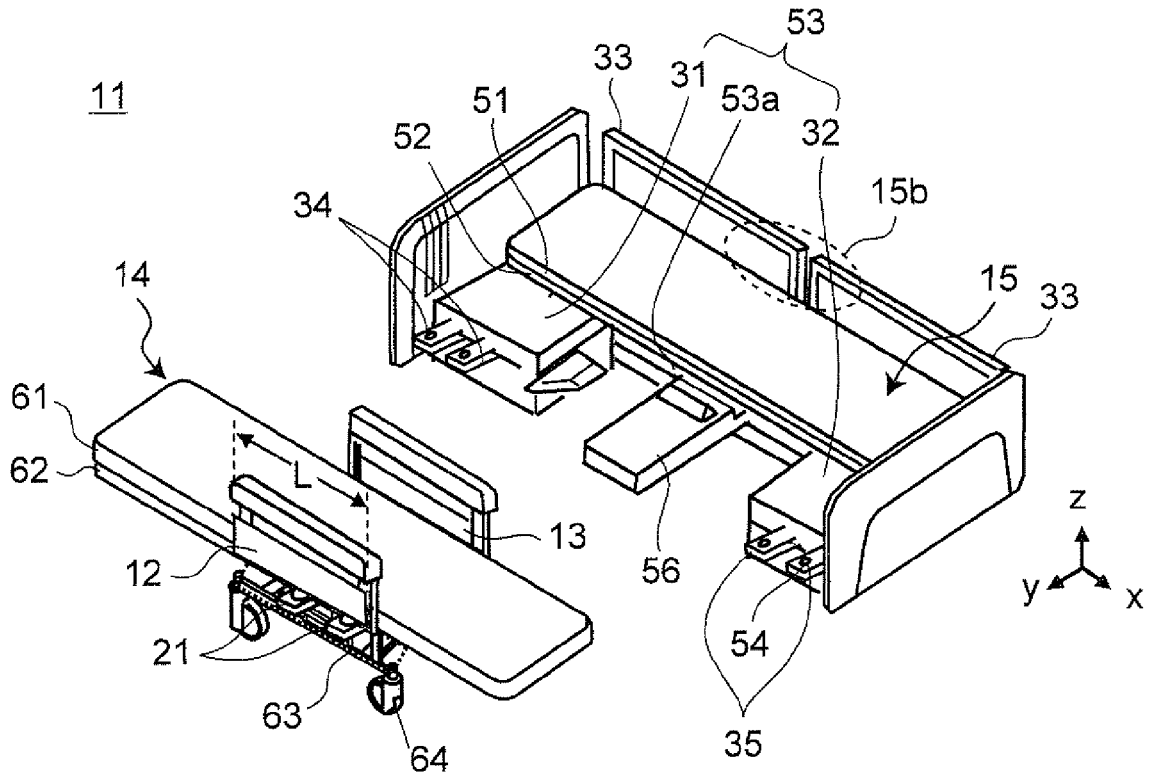
FIG. 17A is a perspective view of the bed in the separated state for illustrating the bed according to a seventh embodiment of the present invention.
Figure 17B:
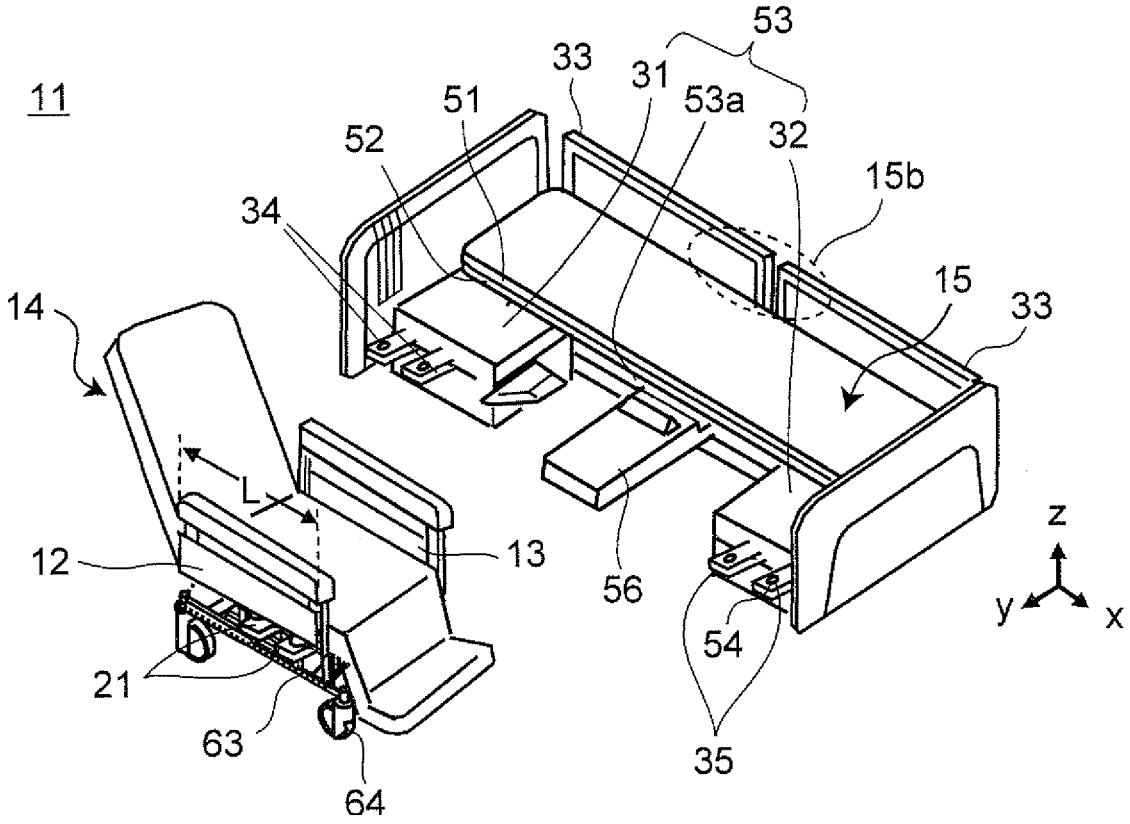
FIG. 17B is a perspective view of the bed in the wheelchair state for illustrating the bed according to the seventh embodiment of the present invention.

FIGS. 17A to 17B are a perspective view of the bed in the separated state and a perspective view of the bed in the wheelchair state for illustrating the bed according to a seventh embodiment of the present invention.

In this seventh embodiment, arrangement positions of the first bed mounting units 34 and the second bed mounting units 35 of the bed main body portion 15 are arranged at positions respectively displaced to the head side and the leg side with respect to the arrangement positions of the first bed mounting units 34 and the second bed mounting units 35 of the above first embodiment. At the same time, arrangement positions of the first armrest mounting units 21 and the second armrest mounting units 22 of the wheelchair 14 in this seventh embodiment are arranged at positions displaced to the leg side of the wheelchair 14. Since the bed mounting units 34, 35 and the armrest mounting units 21, 22 are arranged at the displaced positions in such a way, a space for coupling to the wheelchair 14, that is, the coupling mechanism portion 56 and the accommodation space G can be enlarged. Therefore, in the seventh embodiment, coupling and separation actions of the wheelchair 14 and the bed main body portion 15 can be stably performed. The arrangement positions of the pair of first armrest mounting units 21 are also arranged at the positions displaced to the leg side of the wheelchair 14. Thus, when the rail is attached to the wheelchair 14, the rail protrudes toward the leg side of the wheelchair 14, so that the rail is stabilized as an armrest of the wheelchair 14.

It should be noted that by appropriately combining arbitrary embodiment(s) or modification(s) among the above various embodiments or modifications, effects provided in the embodiment(s) and the modification(s) can be obtained.

INDUSTRIAL APPLICABILITY

The bed and the separating method of the same according to the present invention are useful as a bed in which a part thereof can be separated as a wheelchair, the wheelchair and the bed for providing nursing care to a bedridden aged person or an ailing person, and a separating method of the same.

Although the present invention has been fully described in connection with the embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The invention claimed is:

1. A bed, comprising:

a first rail;

a second rail;

a wheelchair having a first armrest mounting unit to and from which the first rail is attachable and detachable in a first side part thereof, and a second armrest mounting unit to and from which the second rail is attachable and detachable in a second side part thereof; and a bed main body portion having a first support portion and a second support portion in a first side part thereof and a bed rail in a second side part thereof, wherein the first support portion has a first bed mounting unit to and from which the first rail or the second rail is attachable and detachable, and the second support portion has a second bed mounting unit to and from which the first rail or the second rail is attachable and detachable.

2. The bed according to claim 1, wherein the first rail is attachable to and detachable from the first armrest mounting unit as an armrest of the wheelchair, the second rail is attachable to and detachable from the second armrest mounting unit as an armrest of the wheelchair, the first rail is attachable to and detachable from the first bed mounting unit as a bed rail of the bed, and the second rail is attachable to and detachable from the second bed mounting unit as a bed rail of the bed.

3. The bed according to claim 1, wherein the first support portion is positioned in a front end of the first bed mounting unit protruding toward a side of the first armrest mounting unit, and the second support portion is positioned in a front end of the second bed mounting unit protruding toward the side of the first armrest mounting unit.

4. The bed according to claim 1, wherein in a case where the wheelchair and the bed main body portion are coupled, the first armrest mounting unit is arranged between the first bed mounting unit and the second bed mounting unit.

5. The bed according to claim 1, wherein both the first rail and the second rail have a support body, and an armrest portion provided in an upper part of the support body, the armrest portion protruding toward a side thereof only on one side surface of the support body, in a case where the first rail is installed in the first armrest mounting unit and the second rail is installed in the second armrest mounting unit, the armrest portion of the first rail and the armrest portion of the second rail protrude toward an outer side of the wheelchair, and in a case where the first rail is installed in the first bed mounting unit and the second rail is installed in the second bed mounting unit, the armrest portion of the first rail and the armrest portion of the second rail protrude in an opposite direction to the bed rail.

6. The bed according to claim 5, wherein the first rail and the second rail have a plate portion covering a surface of the support body, and there is a gap between the armrest portion and the plate portion.

7. The bed according to claim 1, wherein a state that support rod portions extending from lower ends of the first rail and the second rail are inserted into insertion holes of the first armrest mounting unit, the second armrest mounting unit, the first bed mounting unit, and the second bed mounting unit is a state that the support rod portions are coupled to the mounting units, the insertion holes each have a non-point symmetrical shape with respect to a center of each of the insertion holes, and each of the support rod portions has a same shape as a shape of each of the insertion holes.

8. The bed according to claim 1, wherein the bed main body portion has a coupling mechanism portion to be brought into contact with a convex portion of the wheelchair to lock the wheelchair.

9. The bed according to claim 8, wherein the coupling mechanism portion includes a locking projection and an elastic portion supporting the locking projection.

10. The bed according to claim 1, wherein in the coupling mechanism portion, lock of the wheelchair is cancelled by installing the second rail in the second armrest mounting unit.

11. A separating method of the bed according to claim 1, comprising:

a first armrest formation step for removing the second rail from the second bed mounting unit and installing the second rail in the second armrest mounting unit; and a second armrest formation step for removing the first rail from the first bed mounting unit and installing the first rail in the first armrest mounting unit.

12. The separating method of the bed according to claim 11, further comprising, before the first armrest formation step and the second armrest formation step, moving the wheelchair to expose the second armrest mounting unit between the wheelchair and the bed main body portion.

13. The separating method of the bed according to claim 12, further comprising in a state that the wheelchair is locked to the bed main body portion, moving the wheelchair to expose the second armrest mounting unit between the wheelchair and the bed main body portion.

14. A bed, comprising:

a first rail;

a second rail; and a wheelchair having a first armrest mounting unit to and from which the first rail is attachable and detachable in a first side part thereof, a second armrest mounting unit to and from which the second rail is attachable and detachable in a second side part thereof, and a bed main body portion having a first bed mounting unit and a second bed mounting unit arranged so as to sandwich the first armrest mounting unit between the first bed mounting unit and the second bed mounting unit in the first side part thereof;

wherein the bed main body portion has a bed rail in a side part thereof, and the first rail or the second rail is attachable to and detachable from the first bed mounting unit and the second bed mounting unit.

* * * * *